US009981463B2

(12) United States Patent
Kaneko

(10) Patent No.: US 9,981,463 B2
(45) Date of Patent: May 29, 2018

(54) METHOD FOR MANUFACTURING LIQUID DISCHARGING APPARATUS, LIQUID DISCHARGING APPARATUS, AND DEVICE DRIVER

(71) Applicant: SEIKO EPSON CORPORATION, Tokyo (JP)

(72) Inventor: Tomoshige Kaneko, Kamiina-gun (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/460,390

(22) Filed: Mar. 16, 2017

(65) Prior Publication Data

US 2017/0291410 A1 Oct. 12, 2017

(30) Foreign Application Priority Data

Apr. 12, 2016 (JP) ..... 2016-079284

(51) Int. Cl.
*B41J 2/045* (2006.01)
*B41J 2/16* (2006.01)

(52) U.S. Cl.
CPC ..... *B41J 2/04505* (2013.01); *B41J 2/04586* (2013.01); *B41J 2/162* (2013.01); *B41J 2/1632* (2013.01)

(58) Field of Classification Search
CPC .... B41J 2/04505; B41J 2/04586; B41J 2/162; B41J 2/1632
See application file for complete search history.

(56) References Cited

U.S. PATENT DOCUMENTS 6,367,903 B1 * 4/2002 Gast ..... B41J 2/04505 347/19
2010/0039466 A1 2/2010 Takahashi et al.
2010/0039468 A1 2/2010 Miyamoto et al.

FOREIGN PATENT DOCUMENTS

JP 2010-042595 A 2/2010
JP 2010-042616 A 2/2010
JP 2011-235524 A 11/2011
JP 2014-148057 A 8/2014

* cited by examiner

*Primary Examiner* — Thinh H Nguyen
(74) *Attorney, Agent, or Firm* — Workman Nydegger

(57) ABSTRACT

A method for manufacturing a liquid discharging apparatus having a liquid discharging head that is attached to an apparatus main body so as to be capable of being attached or detached and that discharges a liquid from a nozzle includes: identifying an alignment shift of the liquid discharging head attached to the apparatus main body; and identifying correction information that is correlated with the alignment shift identified in the identifying of the alignment shift based on a correction information table in which the correction information related to liquid discharge control and the alignment shift are correlated with each other.

11 Claims, 15 Drawing Sheets

| SHADE VALUE / NOZZLE NO. | 0 | 1 | 2 | 3 | 4 | 5 | | | 250 | 251 | 252 | 253 | 254 | 255 |
|---|---|---|---|---|---|---|---|---|---|---|---|---|---|---|
| #1 | 0 | 1 | 2 | 2 | 4 | 5 | | | 248 | 250 | 251 | 253 | 253 | 253 |
| #2 | 0 | 1 | 2 | 3 | 4 | 6 | | | 251 | 251 | 253 | 253 | 253 | 254 |
| #3 | 0 | 1 | 2 | 3 | 3 | 4 | | | 247 | 249 | 253 | 254 | 254 | 255 |
| | | | | | | | | | | | | | | |
| #358 | 0 | 1 | 2 | 3 | 5 | 5 | | | | | | | | |
| #359 | 0 | 1 | 2 | 4 | 4 | 6 | | | 250 | 252 | 250 | 253 | 252 | 254 |
| #360 | 0 | 1 | 2 | 3 | 4 | 4 | | | 251 | 250 | 251 | 253 | 252 | 253 |

FIG. 7

| LINE INCLINATION / NOZZLE NO. | ··· | −0. 04 | −0. 03 | −0. 02 | −0. 01 | 0 | 0. 01 | 0. 02 | 0. 03 | 0. 04 | ··· |
|---|---|---|---|---|---|---|---|---|---|---|---|
| #1 | ··· | α (−4, 1) | α (−3, 1) | α (−2, 1) | α (−1, 1) | 0 | α (1, 1) | α (2, 1) | α (3, 1) | α (4, 1) | ··· |
| #2 | ··· | α (−4, 2) | α (−3, 2) | α (−2, 2) | α (−1, 2) | 0 | α (1, 2) | α (2, 2) | α (3, 2) | α (4, 2) | ··· |
| #3 | ··· | α (−4, 3) | α (−3, 3) | α (−2, 3) | α (−1, 3) | 0 | α (1, 3) | α (2, 3) | α (3, 3) | α (4, 3) | ··· |
| #358 | ··· | α (−4, 358) | α (−3, 358) | α (−2, 358) | α (−1, 358) | 0 | α (1, 358) | α (2, 358) | α (3, 358) | α (4, 358) | ··· |
| #359 | ··· | α (−4, 359) | α (−3, 359) | α (−2, 359) | α (−1, 359) | 0 | α (1, 359) | α (2, 359) | α (3, 359) | α (4, 359) | ··· |
| #360 | ··· | α (−4, 360) | α (−3, 360) | α (−2, 360) | α (−1, 360) | 0 | α (1, 360) | α (2, 360) | α (3, 360) | α (4, 360) | ··· |

FIG. 8

| LINE INCLINATION / X-AXIS ROTATION | ··· | −0.04 | −0.03 | −0.02 | −0.01 | 0 | 0.01 | 0.02 | 0.03 | 0.04 | ··· |
|---|---|---|---|---|---|---|---|---|---|---|---|
| ··· | ··· | ··· | ··· | ··· | ··· | ··· | ··· | ··· | ··· | ··· | ··· |
| −0.04 | ··· | β (−4, −4) | β (−3, −4) | β (−2, −4) | β (−1, −4) | β (0, −4) | β (1, −4) | β (2, −4) | β (3, −4) | β (4, −4) | ··· |
| −0.03 | ··· | β (−4, −3) | β (−3, −3) | β (−2, −3) | β (−1, −3) | β (0, −3) | β (1, −3) | β (2, −3) | β (3, −3) | β (4, −3) | ··· |
| −0.02 | ··· | β (−4, −2) | β (−3, −2) | β (−2, −2) | β (−1, −2) | β (0, −2) | β (1, −2) | β (2, −2) | β (3, −2) | β (4, −2) | ··· |
| −0.01 | ··· | β (−4, −1) | β (−3, −1) | β (−2, −1) | β (−1, −1) | β (0, −1) | β (1, −1) | β (2, −1) | β (3, −1) | β (4, −1) | ··· |
| 0 | ··· | β (−4, 0) | β (−3, 0) | β (−2, 0) | β (−1, 0) | 0 | β (1, 0) | β (2, 0) | β (3, 0) | β (4, 0) | ··· |
| 0.01 | ··· | β (−4, 1) | β (−3, 1) | β (−2, 1) | β (−1, 1) | β (0, 1) | β (1, 1) | β (2, 1) | β (3, 1) | β (4, 1) | ··· |
| 0.02 | ··· | β (−4, 2) | β (−3, 2) | β (−2, 2) | β (−1, 2) | β (0, 2) | β (1, 2) | β (2, 2) | β (3, 2) | β (4, 2) | ··· |
| 0.03 | ··· | β (−4, 3) | β (−3, 3) | β (−2, 3) | β (−1, 3) | β (0, 3) | β (1, 3) | β (2, 3) | β (3, 3) | β (4, 3) | ··· |
| 0.04 | ··· | β (−4, 4) | β (−3, 4) | β (−2, 4) | β (−1, 4) | β (0, 4) | β (1, 4) | β (2, 4) | β (3, 4) | β (4, 4) | ··· |
| ··· | ··· | ··· | ··· | ··· | ··· | ··· | ··· | ··· | ··· | ··· | ··· |

METHOD FOR MANUFACTURING LIQUID DISCHARGING APPARATUS, LIQUID DISCHARGING APPARATUS, AND DEVICE DRIVER

CROSS-REFERENCE TO RELATED APPLICATIONS

The entire disclosure of Japanese Patent Application No.: 2016-079284, filed Apr. 12, 2016 is incorporated by reference herein.

BACKGROUND

1. Technical Field

The present invention relates to a method for manufacturing a liquid discharging apparatus, such as an ink jet recording apparatus, a liquid discharging apparatus, and a device driver.

2. Related Art

A liquid discharging apparatus is an apparatus that is provided with a liquid discharging head and that discharges (ejects) various liquids from nozzles of this liquid discharging head. This liquid discharging apparatus is applied to, for example, an image recording apparatus such as an ink jet printer and an ink jet plotter and is also recently applied to various manufacturing apparatuses by taking advantage of a feature in which an extremely small amount of liquid can be accurately landed at a predetermined position. For example, this liquid discharging apparatus is applied to a display manufacturing apparatus that manufactures a color filter such as a liquid crystal display, an electrode forming apparatus that forms an electrode such as an organic electroluminescent (EL) display and a field emission display (FED), and a chip manufacturing apparatus that manufactures a biochip (biochemical element). Then, a recording head for the image recording apparatus discharges a liquid ink and a color material discharging head for the display manufacturing apparatus discharges a solution of each of color materials, including red (R), green (G), and blue (B), from nozzles. In addition, an electrode material discharging head for the electrode forming apparatus discharges a liquid electrode material and a bioorganic material discharging head for the chip manufacturing apparatus discharges a solution of a bioorganic material from nozzles.

Since the liquid discharging head provided in the liquid discharging apparatus and the liquid discharging apparatus have individual differences due to a manufacturing error, variations in discharge characteristics, including an amount of liquid discharged from the nozzles, a flying speed (initial speed), and a flying direction, occur in a case where liquid discharge control is uniformly performed. Accordingly, in some cases, density unevenness (banding) is generated in a result (for example, a print image, which is an image printed on a recording medium) of a liquid discharging operation. For this reason, in a testing step after manufacturing and before product shipment, each liquid discharging apparatus is tested by all nozzles of the liquid discharging head printing a test pattern for identifying the density unevenness and correction information according to characteristics of each of the nozzles is acquired. Then, in a case where the liquid discharging operation is performed by the liquid discharging apparatus, the density unevenness or the like due to variations in discharge characteristics of the liquid discharging apparatus is prevented by correcting data related to discharge of the liquid or the like based on the above correction information (for example, refer to JP-A-2011-235524).

However, an attachment error of the liquid discharging head with respect to the apparatus main body occurs in a case where the liquid discharging head is attached to the apparatus main body in a stage when the liquid discharging apparatus comes into a customer (user)'s hands and in a case where the liquid discharging head temporarily removed from the apparatus main body due to maintenance or failure is attached thereto again or is replaced with a new liquid discharging head. Then, the density unevenness (banding) is generated due to this attachment error as well. In response to this point, a method in which a service person in charge of repairing and maintaining the liquid discharging apparatus makes the customer perform work of printing the test pattern for identifying the density unevenness using all nozzles and acquiring correction information which reflects the attachment error based on the test pattern has been considered but printing the test pattern using all nozzles has a problem of requiring effort and time by the number of used nozzles. In particular, in a case where the number of shades of a pattern printed as the test pattern is more than one, in a case where test patterns corresponding to a plurality of different temperatures are printed, or in a case where a test pattern for each of a plurality of different types of operation modes is printed, there is a problem of requiring more effort and time by the number of printed shades, test patterns corresponding to different temperatures, or test patterns for operation modes and thereby causing a greater burden to the user and the service person as well.

SUMMARY

An advantage of some aspects of the invention is to provide a method for manufacturing a liquid discharging apparatus, a liquid discharging apparatus, and a device driver that can achieve efficiency of adjustment processing performed when attaching a liquid discharging head to the liquid discharging apparatus.

According to an aspect of the invention, there is provided a method for manufacturing a liquid discharging apparatus having a liquid discharging head that is attached to an apparatus main body so as to be capable of being attached or detached and that discharges a liquid from a nozzle, the method including identifying an alignment shift of the liquid discharging head attached to the apparatus main body and identifying correction information that is correlated with the alignment shift identified in the identifying of the alignment shift based on a correction information table in which the correction information related to liquid discharge control and the alignment shift are correlated with each other.

According to the invention, even in a case where the liquid discharging head is attached to the apparatus main body in a stage when the liquid discharging apparatus comes into a user's hands and in a case where the liquid discharging head temporarily removed from the apparatus main body due to maintenance or failure is attached thereto again or is replaced with a new liquid discharging head, effort and time taken for printing the test pattern for identifying the density unevenness using all nozzles and acquiring each piece of correction information for individual nozzle from the test pattern can be lowered since the correction information correlated with the alignment shift is identified based on the correction information table in which the alignment shift and the correction information are correlated with each other once the alignment shift is identified. As a result, a burden to the user or the service person can be alleviated.

In the above configuration, a configuration in which the alignment shift is a relative position shift between the apparatus main body and the liquid discharging head may be adopted.

According to this configuration, liquid density unevenness on a landing target attributable to the relative position shift between the apparatus main body and the liquid discharging head can be prevented.

In addition, in the above configuration, a configuration in which the alignment shift is inclination of the liquid discharging head with respect to the apparatus main body may be adopted.

According to this configuration, liquid density unevenness on the landing target attributable to the inclination of the liquid discharging head with respect to the apparatus main body can be prevented.

In addition, in the above configuration, a configuration in which the liquid discharging head is fixed to a head fixing surface in the apparatus main body so as to be capable of being attached or detached and the alignment shift is inclination of the liquid discharging head in a plane parallel to the head fixing surface may be adopted.

According to the above configuration, since the attached position of the liquid discharging head in a direction orthogonal to the head fixing surface is defined by fixing the liquid discharging head to the head fixing surface, the correction information data amount can be reduced without having the correction information related to the direction being required.

Furthermore, in the above configuration, a configuration in which the liquid discharging head has a plurality of head units and the alignment shift is a relative position shift between the head units may be adopted.

According to this configuration, liquid density unevenness on the landing target attributable to the relative position shift between the head units can be prevented.

In addition, in the above configuration, a configuration in which the correction information is correction information corresponding to only nozzles having a common region on a landing target to which the liquid is discharged between the head units may be adopted.

According to the above configuration, the correction information data amount can be reduced since the correction information in the correction information table is only the correction information corresponding to only the nozzles having the common region on the landing target to which the liquid is discharged between the head units.

In addition, in the above configuration, a configuration in which the correction information includes second nozzle complementary correction information related to complementary control for complementing discharge control of a first nozzle may be adopted.

According to the above configuration, more appropriate complementary control is possible also in a case where the alignment shift occurs.

In addition, according to another aspect of the invention, there is provided a liquid discharging apparatus including a liquid discharging head that is attached to an apparatus main body so as to be capable of being attached or detached and that discharges a liquid from a nozzle, an input unit into which alignment information related to an alignment shift of the liquid discharging head in the apparatus main body is input, and a control circuit that identifies correction information from the alignment information and that applies the identified correction information to liquid discharge control performed by the liquid discharging head based on a correction information table in which the correction information related to the liquid discharge control and the alignment shift are correlated with each other.

According to the invention, even in a case where the liquid discharging head is attached to the apparatus main body in a stage when the liquid discharging apparatus comes into a user's hands and in a case where the liquid discharging head temporarily removed from the apparatus main body due to maintenance or failure is attached thereto again or is replaced with a new liquid discharging head, a decline in the quality of the print image, which is a result of a liquid discharging operation, can be prevented since the correction information is identified based on the alignment information and the correction information is applied to the liquid discharge control.

In addition, in the above configuration, a configuration in which the control circuit changes, based on the alignment information, the number of nozzles to be used in the liquid discharge control performed by the liquid discharging head may be adopted.

According to the above configuration, since an area in which the liquid can be landed onto the landing target becomes wider or narrower depending on the alignment shift, the area can be kept within an appropriate area by changing the number of nozzles in such a case.

Furthermore, in the above configuration, a configuration in which the control circuit changes, based on the alignment information, a discharge amount for the nozzle positioned at a nozzle group end of the nozzle group that discharges the same type of the liquid in the liquid discharging head may be adopted.

According to the above configuration, since the area in which the liquid can be landed onto the landing target becomes wider or narrow depending on the alignment shift, the area can be apparently kept within an appropriate area by changing the discharge amount of the nozzles positioned at the nozzle group end in such a case.

In addition, according to still another aspect of the invention, there is provided a device driver that is executable in an information processing apparatus capable of communicating with a liquid discharging apparatus and identifies correction information related to discharge control of a liquid discharging head based on alignment information related to an alignment shift of the liquid discharging head in an apparatus main body of the liquid discharging apparatus.

BRIEF DESCRIPTION OF THE DRAWINGS

The invention will be described with reference to the accompanying drawings, wherein like numbers reference like elements.

FIG. 7 is a view illustrating an example of an alignment correction table related to line inclination.

FIG. 8 is a view illustrating an example of an alignment correction table related to the line inclination and inclination of a nozzle surface of which a rotation axis is set to the X-axis.

DESCRIPTION OF EXEMPLARY EMBODIMENTS

Figure 1:
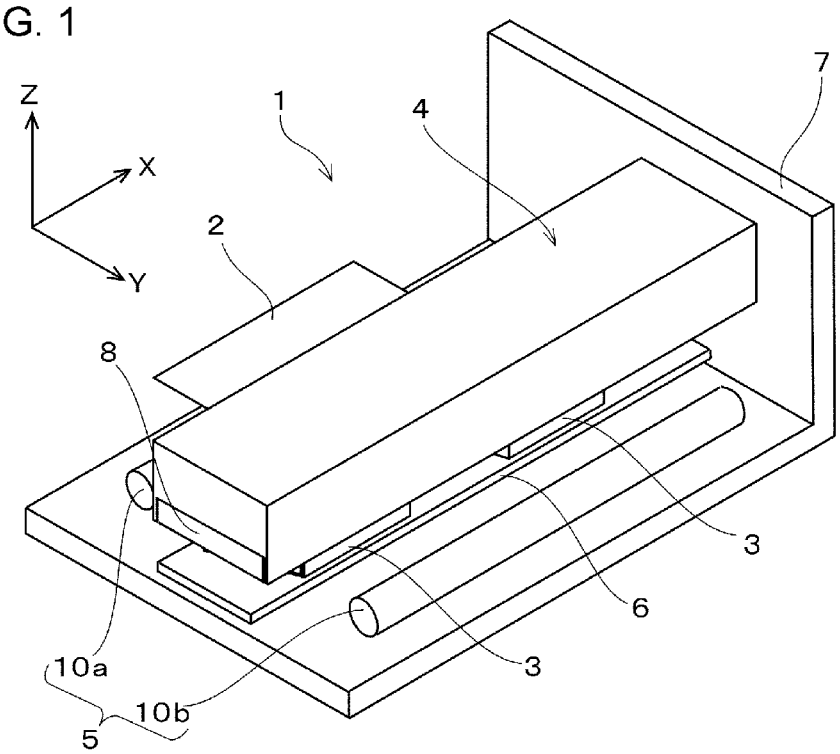
FIG. 1 is a perspective view illustrating a configuration of a liquid discharging apparatus (printer).

Hereinafter, an embodiment of the invention will be described with reference to the accompanying drawings. In the embodiment below, a variety of limitations to the invention are used as preferable and specific examples, but the scope of the invention is not limited to the forms described below insofar as there is no particular description to limit the spirit of the invention. In addition, in the following explanation, an ink jet recording apparatus (hereinafter, a printer) will be described as an example of a liquid discharging apparatus of the invention.

First, a configuration of a printer 1 will be described. The printer 1 in this embodiment is an apparatus that forms dots by discharging liquid inks onto an outer surface of a recording medium 2 (a type of a landing target of a liquid) including recording paper and prints (records) an image or the like by array of the dots. More specifically, the printer 1 is a so-called line printer that performs a printing operation (liquid discharging operation) while transporting the recording medium 2 without a recording head 4 performing a scanning. Inside an apparatus main body 7, the printer 1 in this embodiment is provided with the recording head 4 (corresponds to a liquid discharging head in the invention) that has a plurality of head units 3 which are in a state of being attached to a unit holding member 8, a transporting mechanism 5 that transports the recording medium 2, and a medium supporting portion 6 that supports the recording medium 2 which is in a state of facing a bottom surface (nozzle surface) of each of the head units 3 in the recording head 4. Hereinafter, as appropriate, a transporting direction of the recording medium 2 will be referred to as Y-axis direction, a width direction of the recording medium 2 (length direction of the recording head 4) will be referred to as X-axis direction, and a direction orthogonal to a supporting surface of the medium supporting portion 6 will be referred to as Z-axis direction.

The recording head 4 in this embodiment is formed into a unit by the plurality of head units 3 being attached to the unit holding member 8 in a direction (X-axis direction) orthogonal to the transporting direction of the recording medium 2 (Y-axis direction) and is fixed in a posture where the nozzle surface of each of the head units 3 faces the medium supporting portion 6 (platen) to the apparatus main body 7. Each of the head units 3 is configured such that inks from an ink cartridge (not illustrated) storing the inks, which are a type of the liquid in the invention, is supplied. This ink cartridge may be configured so as to be mounted in the recording head 4 or this ink cartridge may be configured so as to be disposed at a position different from that of the recording head 4 in the apparatus main body 7 and such that the inks are supplied to each of the head units 3 via a supply tube or the like.

The transporting mechanism 5 is provided with a pair of first upper and lower transporting rollers 10*a* disposed on an upstream side of the medium supporting portion 6 in a transporting direction of the recording medium and a pair of second upper and lower transporting rollers 10*b* disposed on a downstream side of the medium supporting portion 6 in the transporting direction. The transporting mechanism 5 causes the recording medium 2 from a supply side to pass through on the medium supporting portion 6 in a state of being pinched between the upper and lower rollers and to be transported toward an output side by driving these transporting rollers 10*a* and 10*b*.

The medium supporting portion 6 in this embodiment is a plate-shaped support base that is long in a direction where the head units 3 are arranged in parallel with each other and supports the recording medium 2, a target onto which an image or the like is printed by the recording head 4. The transporting mechanism 5 is configured of an endless belt and a drum. In such a configuration, the belt or the drum functions as a medium supporting portion. In addition, a medium supporting portion with a configuration in which the recording medium 2 is adsorbed by an electrostatic force or a configuration in which the recording medium 2 is adsorbed by generating a negative pressure can be adopted as the medium supporting portion 6.

Figure 2:
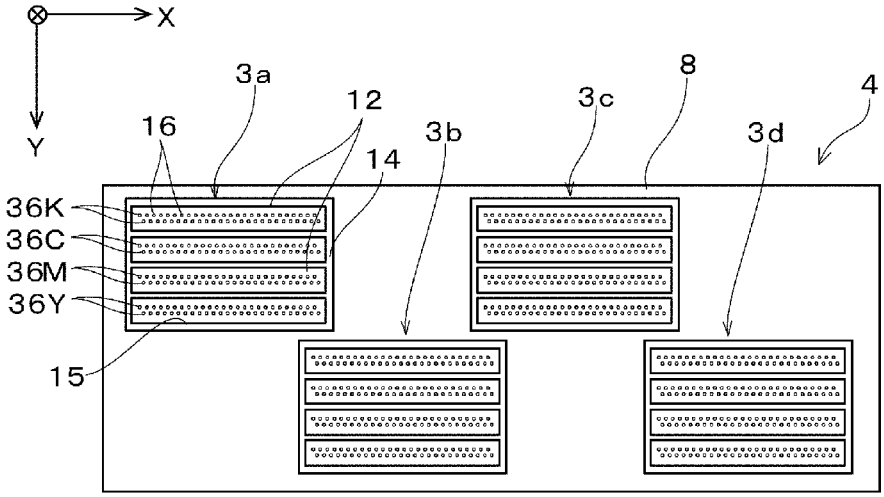
FIG. 2 is a bottom view of a liquid discharging head (recording head).

FIG. 2 is a bottom view of the recording head 4. The plurality of (in total, four in this embodiment) head units 3 are lined up in the X-axis direction such that the positions of the head units 3 in the Y-axis direction are different from each other on a lower surface of the unit holding member 8 in the recording head 4, that is, a surface on a medium supporting portion 6 side and are held so as to be capable of being attached or detached by screwing or the like. Each of the head units 3 is provided with a plurality of unit heads 12 (head chips) and fixing plates 14 that protect each of the unit heads 12. The unit heads 12 are configured of configuration members, including a nozzle plate 17 on which nozzle lines 36 made by a plurality of nozzles 16 being arranged in parallel with each other are formed as will be described later, a substrate in which an ink flow path communicating with the nozzles 16 is formed, and an actuator unit, which is a drive source to discharge the ink, being stacked.

The fixing plate 14 is a metal plate member that is common to each of the unit heads 12 provided in the head unit 3 and is made by pressing. To expose the nozzles 16 (nozzle lines) formed on the nozzle plate 17, a long through-hole 15 is formed in a nozzle line direction in each of this fixing plate 14 at a position corresponding to the nozzle plate 17 of each of the unit heads 12. Each of the unit heads 12 is bonded to an upper surface (a surface on a side opposite to the medium supporting portion 6 side) of the fixing plate 14 with an adhesive or the like in a state where each of the nozzles 16 is exposed through the corresponding through-hole 15. By bonding the nozzle plate 17 to this fixing plate 14, the height of each of the unit heads 12, that is, the position of each of the unit heads 12 in a direction orthogonal to the nozzle plate 17 is defined. In this embodiment, the nozzle surface, which is a bottom surface of the head unit 3, is configured of a lower surface (surface of the fixing plate 14 on the medium supporting portion 6 side) of the fixing plate 14 and a portion of the nozzle plate 17 exposed through the through-hole 15.

Each of the above head units 3 is fixed to the lower surface of the unit holding member 8 by screwing or the like in a state where a relative position of each head unit 3 is defined. However, due to an attachment error or the like, the relative position shifts of the head units 3 with respect to the unit holding member 8 (position shift in the X-axis direction and the Y-axis direction) and a shift (alignment shift) from the originally attached position or posture, including inclination (inclination about a rotation direction when the X-axis, the Y-axis, or the Z-axis is set as a rotation axis) of the nozzle surface, might occur. In addition, also in a case where the recording head 4 is attached to the apparatus main body 7, a relative position shift of the recording head 4 with respect to the apparatus main body 7 or an alignment shift including inclination of the nozzle surface occurs in some cases due to the attachment error or the like. In this embodiment, it is configured that these alignment shifts are detected, correction information correlated with the alignment shift is identified based on a correction information table in which the correction information according to ink discharge control and the alignment shift are correlated and the correction information is applied to control of the printing operation (liquid discharging operation) with respect to the recording medium 2. Details of this point will be described later.

Figure 3:
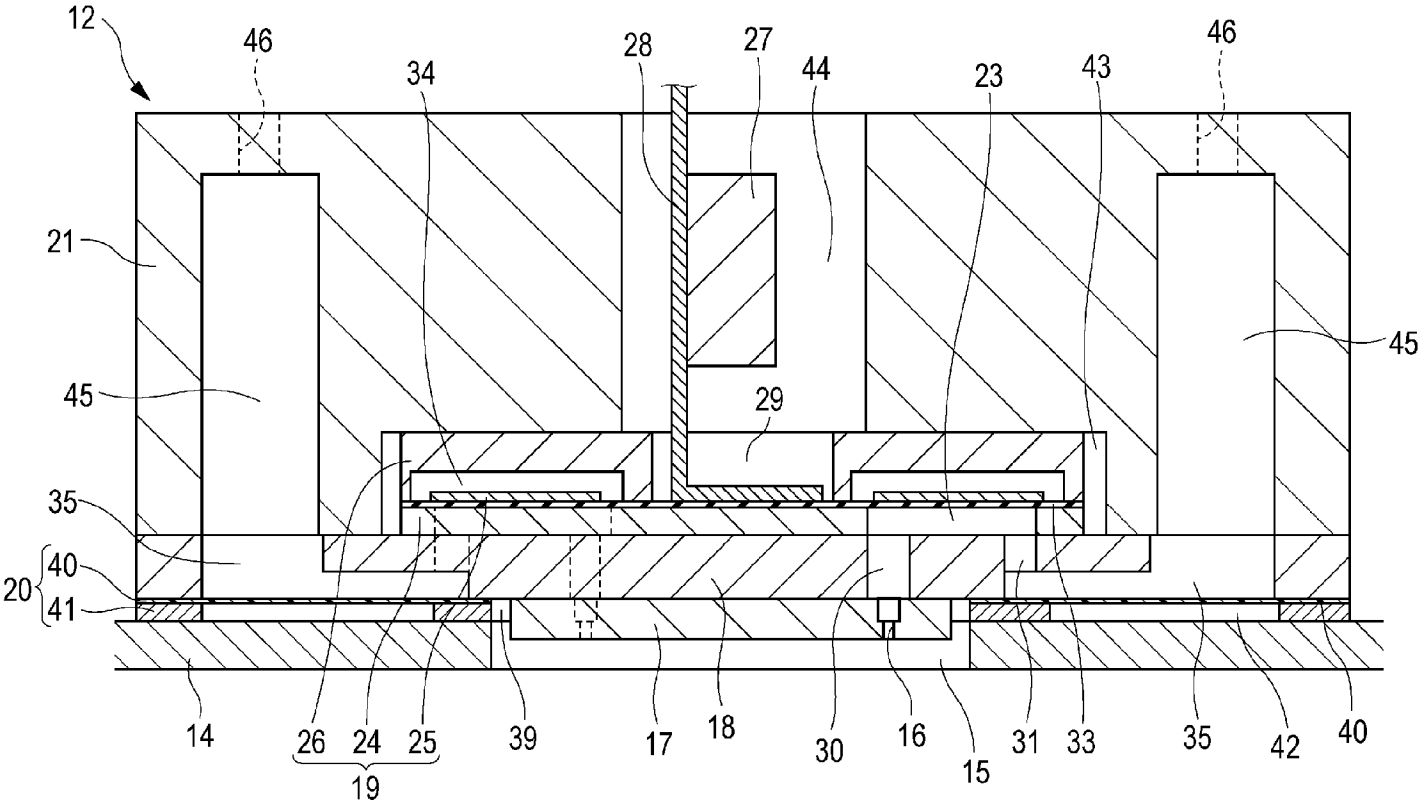
FIG. 3 is a sectional view illustrating a configuration of a unit head.

FIG. 3 is a sectional view illustrating a configuration of the unit head 12. Although FIG. 3 illustrates a configuration of only one of the plurality of unit heads 12, other unit heads 12 have the same configuration. The unit heads 12 in this embodiment are formed into a unit by stacking and bonding a plurality of configuration members, including the fixing plate 14, the nozzle plate 17, a communication plate 18, an actuator substrate 19, a compliance substrate 20, and a case 21, with the adhesive or the like. Hereinafter, starting from the fixing plate 14, a direction in which each of the configuration members of the unit head 12 is stacked will be appropriately referred to as an up-and-down direction.

The actuator substrate 19 in this embodiment is provided with, in a state of being stacked, a pressure chamber forming substrate 24 in which a pressure chamber 23 communicating with the nozzles 16 formed in the nozzle plate 17 is formed, a piezoelectric element 25 which is a drive element that brings about pressure fluctuations in the inks within each pressure chamber 23, and a protective substrate 26 which protects the pressure chamber forming substrate 24 and the piezoelectric element 25. A wiring gap 29 into which a flexible substrate 28 provided with a drive IC 27 is inserted is in a substantially middle portion in plan view of the protective substrate 26. A lead electrode of the piezoelectric element 25 is disposed within this wiring gap 29 and a wiring terminal of the flexible substrate 28 is electrically connected to this lead electrode. A drive signal or the like sent from a control unit is supplied to the piezoelectric element 25 through the flexible substrate 28. Without being limited to the flexible substrate 28 provided with the drive IC 27, a configuration in which the drive IC 27 is additionally disposed on an upper portion of the protective substrate 26 via a so-called interposer and the drive IC 27 is not provided in the flexible substrate 28 can be adopted as well.

The pressure chamber forming substrate 24 of the actuator substrate 19 is made of a silicon single crystal substrate. In this pressure chamber forming substrate 24, a plurality of spaces to become the pressure chambers 23 are provided, corresponding to each of the nozzles 16. This pressure chamber 23 is a gap, which is long in a direction of intersecting (in this embodiment, being orthogonal to) the nozzle line. A nozzle communication hole 30 communicates with an end portion on one side in a longitudinal direction of this pressure chamber 23 and an individual communication hole 31 communicates with an end portion on the other side. Two lines of the pressure chambers 23 are formed in the pressure chamber forming substrate 24 in this embodiment.

A diaphragm 33 is stacked on an upper surface (surface on a side opposite to a communication plate 18 side) of the pressure chamber forming substrate 24 and an upper portion opening of the pressure chamber 23 is sealed with this diaphragm 33. That is, a part of the pressure chamber 23 is partitioned by the diaphragm 33. This diaphragm 33 consists of, for example, an elastic film that is formed on the upper surface of the pressure chamber forming substrate 24 and that is made of silicon dioxide ($SiO_2$) and an insulator film that is formed on this elastic film and that is made of zirconium oxide ($ZrO_2$). Then, each of the piezoelectric elements 25 is stacked in a region corresponding to each of the pressure chambers 23 on this diaphragm 33.

The piezoelectric element 25 of this embodiment is a so-called bending mode piezoelectric element. This piezoelectric element 25 is formed by sequentially stacking, for example, a lower electrode layer, a piezoelectric layer, and an upper electrode layer (none of them are illustrated) on the diaphragm 33. The piezoelectric element 25, which is configured in such a manner, bends and deforms in the up-and-down direction once an electric field caused by a potential difference between both electrodes is applied between the lower electrode layer and the upper electrode layer. In this embodiment, two lines of the piezoelectric elements 25 are formed, corresponding to the two lines of the pressure chambers 23. The lower electrode layer and the upper electrode layer extend, as the lead electrodes, to the inside of the wiring gap 29 between the lines from the lines of the piezoelectric elements 25 on both sides and the lower electrode layer and the upper electrode layer are electrically connected to the flexible substrate 28 as described above.

The protective substrate 26 is stacked on the diaphragm 33 so as to cover the two lines of the piezoelectric elements 25. A long accommodating space 34 capable of accommodating the lines of the piezoelectric elements 25 are formed on the inside of the protective substrate 26. This accommodating space 34 is a hollow formed in a protective substrate 26 height direction toward an upper surface side (case 21 side) from a lower surface side (diaphragm 33 side) of the protective substrate 26. The accommodating space 34 is formed in each wiring gap 29 provided on both sides in the protective substrate 26 in this embodiment.

The communication plate 18 having a wider area than that of the actuator substrate 19 is bonded to the lower surface of the actuator substrate 19. Similar to the pressure chamber forming substrate 24, this communication plate 18 is made of a silicon single crystal substrate. The nozzle communication hole 30 through which the pressure chamber 23 and the nozzle 16 communicate with each other, a reservoir 35 provided for each pressure chamber, and the individual communication hole 31 through which this reservoir 35 and the pressure chamber 23 communicate with each other are formed in the communication plate 18 in this embodiment. The reservoir 35 (common liquid chamber) is a gap that extends in the nozzle line direction, and two reservoirs 35 are formed in the communication plate 18, corresponding to each nozzle line of the nozzle plate 17. That is, the reservoir 35 is provided for each type of ink. Corresponding to each of the pressure chambers 23, a plurality of individual communication holes 31 are formed in the nozzle line direction. This individual communication hole 31 communicates with an end portion of the pressure chamber 23 on the other side (side opposite to the nozzle communication hole 30) in a longitudinal direction.

The nozzle plate 17 in which the plurality of nozzles 16 are formed is bonded to a substantially middle portion of the lower surface of the above communication plate 18. The nozzle plate 17 in this embodiment is a plate member smaller than the communication plate 18 and the actuator substrate 19 and is configured of a silicon single crystal substrate. In a state where each of these nozzle communication holes 30 and the plurality of nozzles 16 communicate with each other, this nozzle plate 17 is bonded to a lower surface of the communication plate 18 at a position deviated from the opening of the reservoir 35, that is, in a region where the nozzle communication hole 30 is opened, with the adhesive or the like. In total, two nozzle lines 36 (36*a* and 36*b*) formed by the plurality of nozzles 16 being provided are formed in the nozzle plate 17 in this embodiment. A pair of nozzle lines 36*a* and 36*b* is configured such that both nozzle lines discharge the same type (same color) of ink. That is, the unit head 12 in this embodiment is provided for each type of ink.

Figures 5, 6:
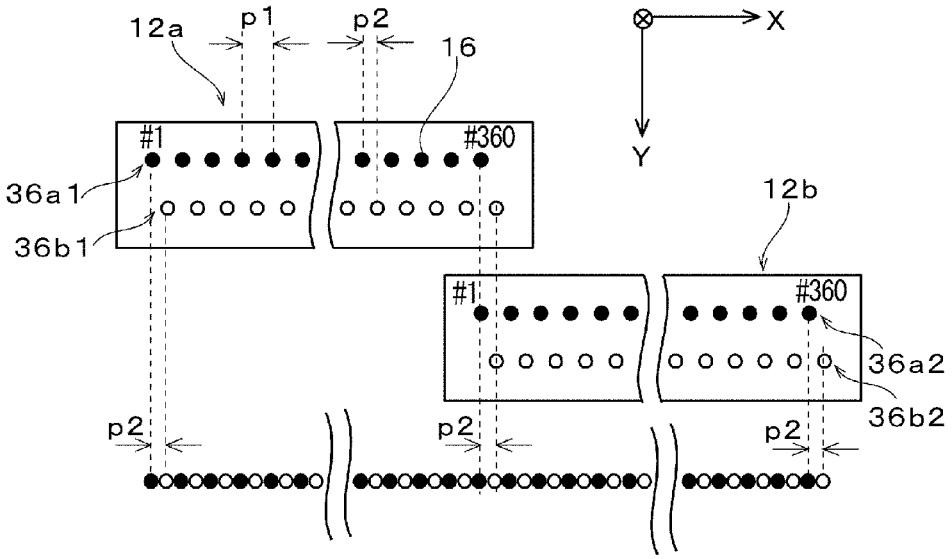
FIG. 5 is a view schematically illustrating dispositions of nozzles and dispositions of dots.
FIG. 6 is a view illustrating an example of a basic correction table.

FIG. 5 is a view schematically illustrating dispositions of the nozzles 16 and dispositions of dots on the recording medium formed with the inks discharged from each of the nozzles 16. FIG. 5 illustrates only the nozzle lines 36 of the unit heads 12*a* and 12*b* of the head units 3 that are adjacent to each other, which correspond to the same color of ink. In addition, the nozzles 16 of the nozzle line 36*a* positioned on the upstream side in the Y-axis direction in the same unit head 12 and dots formed by these nozzles are denoted by black circles and the nozzles 16 of the nozzle line 36*b* positioned on the downstream side and dots formed by these nozzles are denoted by white circles. In addition, from one end (left in FIG. 5), each nozzle 16 that configures the nozzle line 36 is assigned with a serial number of 1 to 360. Since each of the head units 3 in this embodiment has four unit heads 12, each of the head units 3 has eight nozzle lines 36 in total as illustrated in FIG. 2 and is capable of discharging four colors of inks in total, including black (K), cyan (C), magenta (M), and yellow (Y). In this embodiment, the nozzle line 36 is configured of, for example, 360 nozzles 16, and each of the nozzles 16 is arranged at a predetermined pitch (center-to-center distance) p1 (for example, pitch corresponding to 360 dpi). In addition, the nozzle lines 36*a* and 36*b* in the same unit head 12, which discharge the same color of ink, are shifted away from each other in the X-axis direction at a pitch p2 (for example, pitch corresponding to 720 dpi), which is half the p1. That is, the nozzles 16 of each head unit 3, which discharge the same color of ink, are arrayed at the above pitch p2 in the X-axis direction, and the full length (total extension) of these nozzles 16 in the X-axis direction is slightly larger than the full width of the recording medium 2 in a maximum size. For this reason, by adjusting discharge timing of each of the nozzle lines 36, dots can be arrayed in the X-axis direction over the full width of the recording medium 2.

In addition, in this embodiment, the position of a 360th nozzle 16 of an upstream side nozzle line 36*a*1 of the unit head 12*a* in one head unit 3 out of the neighboring head units 3 and the position of a first nozzle 16 of an upstream side nozzle line 36*a*2 of the unit head 12*b* in the other head unit 3 are aligned (overlap) in the X-axis direction. Similarly, the position of a 360th nozzle 16 of a downstream side nozzle line 36*b*1 of one unit head 12*a* and the position of a first nozzle 16 of a downstream side nozzle line 36*b*2 of the other unit head 12*b* are aligned in the X-axis direction. In other words, by disposing at least some of the nozzles 16 of the nozzle lines in the same color, which belong to adjacent unit heads 12, at positions so as to overlap each other in the X-axis direction (overlap when seen in the Y-axis direction), a junction between the unit heads 12 can be corrected. That is, degradation of image quality due to a banding (streak-like portion in which a ground color of the recording medium 2 is exposed or dark streak-like portion of which a color is darker than other portions) in the junction of the image formed by the unit heads 12 of the adjacent head units 3 can be prevented from occurring. For example, a streak of the junction can be made less conspicuous by discharging the ink from only one nozzle 16 out of the nozzles 16 (hereinafter, appropriately referred to as overlapping nozzles 16) that overlap each other in a case where a dark streak-like banding occurs in the junction and by discharging the ink from both of the overlapping nozzles 16 in a case where a streak-like banding occurs due to the ground color of the recording medium 2 as a result of leaving a blank as it is in the junction.

The compliance substrate 20, in which a through-opening 39 having a shape according to the outer shape of the nozzle plate 17 is formed in the middle portion, is bonded to the lower surface of the communication plate 18 so as to enclose the surroundings of the nozzle plate 17. The through-opening 39 of this compliance substrate 20 is configured so as to communicate with the through-hole 15 of the fixing plate 14 and such that the nozzle plate 17 is disposed on an inner side of the through-opening 39. In a state of being positioned on the lower surface of the communication plate 18, the compliance substrate 20 seals the opening of the reservoir 35 in the lower surface of the communication plate 18. The compliance substrate 20 in this embodiment is configured of a compliance sheet 40 and a support plate 45 that supports the compliance sheet 40, which are bonded to each other. The compliance sheet 40 of the compliance substrate 20 is bonded to the lower surface of the communication plate 18 and the compliance sheet 40 comes into a state of being interposed between a communication substrate 25 and the support plate 45. The compliance sheet 40 is a thin film having flexibility which is made of, for example, a synthetic resin material including polyphenylene sulfide (PPS). The support plate 45 is formed of a metallic material including stainless steel of which rigidity is higher and of which thickness is larger than those of the compliance sheet 40. In a region of this support plate 45 opposing the reservoir 35, a compliance opening 42 is formed by getting rid of a part of the support plate 45 into a shape according to a lower surface opening of this reservoir 35. For this reason, the opening of the reservoir 35 on a lower surface side is sealed only with the compliance sheet 40 having flexibility. In other words, the compliance sheet 40 partitions a part of the reservoir 35.

A portion corresponding to the compliance opening 42 in the lower surface of the support plate 45 is sealed with the fixing plate 14. Accordingly, a space (compliance space) is formed between a flexible region of the compliance sheet 40 and the fixing plate 14 opposing the flexible region. Then, by the flexible region of the compliance sheet 40 in this space being displaced on a reservoir 35 side or a compliance space side according to pressure fluctuations in the ink flow path, in particular, in the reservoir 35, an abrupt pressure change is mitigated.

The actuator substrate 19 and the communication plate 18 are fixed to the case 21. The case 21 has substantially the same shape as that of the communication plate 18 in plan view and an accommodating gap 43 that accommodates the actuator substrate 19 is formed on a lower surface side thereof. Then, the lower surface of the case 21 is sealed with the communication plate 18 in a state where the actuator substrate 19 is accommodated in the accommodating gap 43. An insertion gap 44 that communicates with the accommodating gap 43 is provided in a substantially middle portion of this case 21. This insertion gap 44 also communicates with the wiring gap 29 of the actuator substrate 19. The above flexible substrate 28 is configured so as to be inserted into the wiring gap 29 through the insertion gap 44. In addition, on the inside of the case 21, liquid chamber gaps 45 that communicate with the reservoirs 35 of the communication plate 18 are formed on both sides of the insertion gap 44 and the accommodating gap 43. In addition, each inlet 46 that communicates with each of the liquid chamber gaps 45 is provided in an upper surface of the case 21. The ink sent from the ink cartridge is introduced into the inlet 46, the liquid chamber gap 45, and the reservoir 35 and is supplied to each of the pressure chambers 23 through the individual communication hole 31 from the reservoir 35.

Then, in the unit head 12 having the above configuration, pressure fluctuations in the ink within the pressure chamber 23 occur by driving the piezoelectric element 25 in accordance with the drive signal from the drive IC 27 in a state where the inside of the flow path ranging from the liquid chamber gap 45 to the nozzle 16 through the reservoir 35 and the pressure chamber 23 is filled with the ink and thus the ink is discharged from a predetermined nozzle 16 by this pressure vibration.

Next, an electrical configuration of the printer 1 according to the invention will be described.

Figure 4:
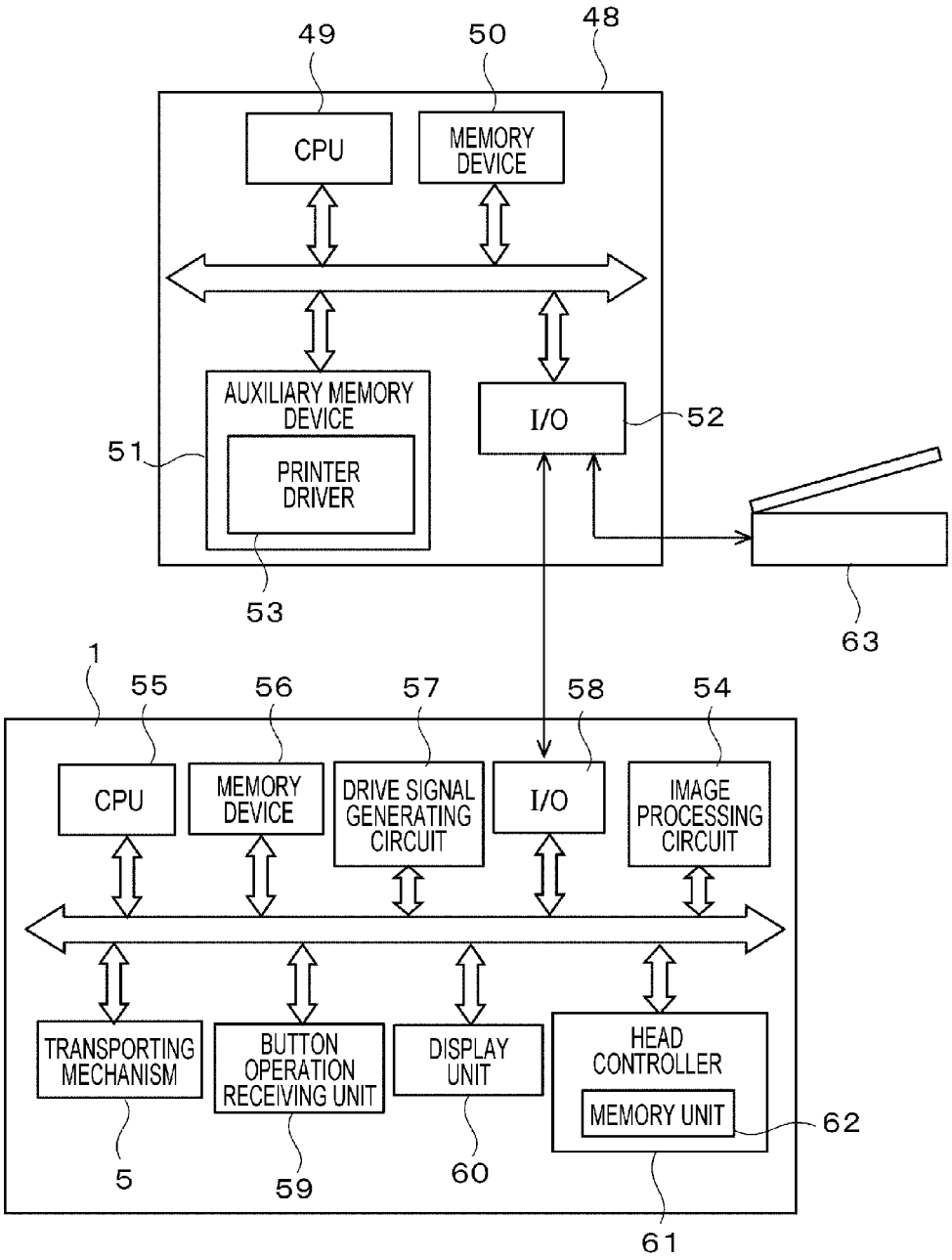
FIG. 4 is a block diagram illustrating an example of a printing system.

FIG. 4 is a block diagram illustrating a printing system including the printer 1. This printing system is configured such that a computer 48, which is a type of an information processing apparatus, and the printer 1, which is a type of the liquid discharging apparatus, are connected in a wired or a wireless manner so as to be capable of communicating with each other. The computer 48 is provided with a CPU 49, a memory device 50, an input/output interface (I/O) 52, and an auxiliary memory device 51, and the aforementioned elements are connected to each other via an internal bus. The auxiliary memory device 51 is configured of, for example, a hard disk drive, and the memory device 50 stores an operation program, various application programs, a printer driver 53 (a type of a device driver in the invention) related to control of the printer 1, a scanner driver (not illustrated) related to control of a scanner 63. Then, the CPU 49 performs various processing including execution of the application program or the printer driver 53 in accordance with an operation system stored in the auxiliary memory device 51. The input/output interface 52 is connected to an input/output interface 58 of the printer 1 and outputs a request of printing operation (discharging operation), printing data related to printing, and printing setting information, which are prepared by the printer driver 53, to this printer 1. In addition, the scanner 63 is connected to the input/output interface 52 and an image read by the scanner 63 is input into the input/output interface 52.

The printer 1 in this embodiment has a CPU 55 (a type of a control circuit in the invention), an image processing circuit 54 (a type of the control circuit in the invention), a memory device 56, the input/output interface 58 (a type of an input unit in the invention), a drive signal generating circuit 57, the transporting mechanism 5, a button operation receiving unit 59 (a type of the input unit in the invention), a display unit 60, and a head controller 61 (a type of the control circuit in the invention), and the like. The input/output interface 58 performs transmitting or receiving of various types of data by receiving the request of printing operation, the printing setting information, and the printing data from the computer 48, or image data or the like read by the scanner 63 or by outputting printer 1 state information from the computer 48. The CPU 55 is an arithmetic processing device for performing control of the entire printer and controls the printing operation (liquid discharging operation) and the like performed by the recording head 4. The memory device 56 is an element that stores data used in programs or various types of control of the CPU 55 and includes a ROM, a RAM, and an NVRAM (nonvolatile memory element). Based on waveform data related to a waveform of the drive signal, the drive signal generating circuit 57 (drive pulse generating circuit) generates a drive signal (refer to FIG. 15) including a drive pulse for driving the piezoelectric element 25 of the recording head 4.

In addition, the image processing circuit 54 converts the printing data (image data) received from an external device, including the computer 48, to data that can be handled by the printer 1 or performs correction processing based on the correction information. More specifically, the image processing circuit 54 converts resolution of RGB image data sent from the computer 48 to printing resolution corresponding to image quality designated through the printer driver 53. In addition, the image processing circuit 54 performs color conversion processing to convert the RGB image data, of which the resolution is converted, to CMYK image data. Herein, the CMYK image data means image data separated for each color of ink including cyan (C), magenta (M), yellow (Y), and black (K) based on the RGB image data for each color including red (R), green (G), and blue (B). Then, a plurality of pieces of pixel data that configure the CMYK image data is expressed as each of a shade value of 256 levels. This shade value is determined based on the RGB image data. In addition, the image processing circuit 54 performs processing of correcting the shade value based on the correction information (correction table (refer to FIG. 6 and FIG. 7)) stored in a memory unit 62 of the head controller 61 which will be described later. Once the CMYK image data is obtained, the image processing circuit 54 performs halftone processing to convert the shade value indicating the pixel data that configures the CMYK image data to the dot shade value for the printing operation of the recording head 4. More specifically, the shade values (shade values after correction) in the 256 levels indicated by CMYK pixel data are converted to the dot shade values in the four levels. For example, the shade values in the 256 levels are converted to the four levels including no dots corresponding to a dot shade value of "00" (non-recording), forming of small dots corresponding to a dot shade value of "01", forming of medium dots corresponding to a dot shade value of "10", and forming of large dots corresponding to a dot shade value of "11".

In addition, after then, once a dot generation rate for the size of each of dots is determined, the image processing circuit 54 prepares the pixel data such that the printer 1 forms dots in a manner that the dots are distributed using a dither method, a y correction, an error diffusion method, and the like. Next, the image processing circuit 54 performs rasterization processing, and the pixel data is changed in the order of data (data of dot shade value) of each dot to be transmitted to the printer 1 first. Then, raster data that has undergone the rasterization processing is sequentially transmitted to the head controller 61 of each of the head units 3.

The head controller 61 is provided for each of the head units 3 and performs control of selectively applying the drive pulse (refer to FIG. 15) in the drive signal generated by the drive signal generating circuit 57 to the piezoelectric element 25 based on the raster data. Accordingly, ink droplets are discharged from each of the nozzles 16 of the head unit 3 and dots having a size according to the dot shade value are formed onto the recording medium 2. By the dots being arrayed, a color image or the like is formed. The head controller 61 controls timing at which the drive pulse is applied to the piezoelectric element 25 based on the correction information related to the discharge timing that will be described later.

The head controller 61 has the memory unit 62 including the nonvolatile memory element, and the memory unit 62 stores the correction table, which is correction information for each of the head units 3. The button operation receiving unit 59 electrically detects operations of various operation buttons provided on an outer surface of a housing of the printer 1 and outputs a detection signal to the CPU 55. Therefore, the CPU 55 can find out which operation button has been operated based on the detection signal from the button operation receiving unit 59. Then, a user of the printer 1 can perform paper setting, setting of various modes, and the like by operating the button operation receiving unit 59 on a print setting screen. The display unit 60 consists of, for example, a liquid crystal display device provided in the housing of the printer 1 and displays the print setting screen and the like under the control of the CPU 55.

Next, a method for manufacturing the printer 1 according to the invention will be described.

In this embodiment, after the printer 1 is manufactured, a dedicated pattern for detecting density unevenness or a dedicated pattern for detecting a ruled line shift is printed in a test stage before shipment from a factory and printing results are read by a scanner or the like. Then, correction information for modifying the generated density unevenness or the generated ruled line shift is determined based on measurement results. The correction information includes, for example, the shade value related to the density of a print image, a formation ratio of dots having various sizes, a peak value of the drive pulse, and information related to ink discharge timing. Hereinafter, the shade value and information related to the discharge timing will be mainly described as examples.

In this embodiment, a basic correction table (refer to FIG. 6) in which a shade value before correction and a shade correction value after correction are correlated with each other with respect to each nozzle 16 that configures the nozzle line 36 provided in the head unit 3 is prepared. Then, based on this basic correction table, it is assumed that an alignment shift of the head unit 3 occurs by attaching the head unit 3 to the printer 1 or by replacing the head unit 3 in a stage when the printer 1 comes into the user's hands and an alignment correction table for recorrecting a corrected value in the basic correction table according to the alignment shift is prepared. The basic correction table and the alignment correction table are stored in the memory unit 62 of each of the head units 3. A configuration in which these correction tables are stored in a server connected to the printer 1 and the computer 48 via a network and are appropriately read from the server can be adopted.

FIG. 6 is a view illustrating an example of the basic correction table. In the basic correction table, each of the nozzles 16 is correlated with the shade value after correction (corrected shade value) based on the above measurement results for each of the shade values. In this embodiment, the nozzle line 36 is configured of 360 nozzles 16, and each of the nozzles 16 is correlated with each corrected shade value for each of the shade values in the 256 levels from 0 to 255 in the basic correction table. For example, 248, which is lower than 250 in density, is specified as the correction value for a shade value 250 of the nozzle 16 with a nozzle number #1.

FIG. 7 is a view illustrating an example of the alignment correction table, which is a type of the correction information table in the invention. In this embodiment, inclination (shift in the rotation direction when the Z-axis is the rotation axis (hereinafter, appropriately referred to as line inclination)) of the nozzle line in the X-axis direction and the Y-axis direction, which is a type of the alignment shift, and correction information $\alpha$ according to the inclination are specified for each of the nozzles 16. The correction information $\alpha$ is configured of a recorrection value for correcting (recorrecting) the shade value (corrected shade value) or one or a plurality of pieces of correction information including information related to correction of the discharge timing. In addition, starting from "0", which is a state where the line inclination does not occur, a value within a range where an attachment error of the head unit 3 is assumed in reality is chosen as a value of the line inclination. A suffix (x, y) of the correction information $\alpha$ indicates coordinates when the line inclination "0" of the nozzle 16 with the nozzle number #1 is set as a reference in the table. The recorrection value for the shade value, out of the correction information $\alpha$, is a coefficient. By the coefficient being added to, subtracted from, or multiplied by the shade correction value in the basic correction table, the shade value is recorrected (optimized) and an alignment shift amount is offset in a case where the applicable alignment shift occurs. That is, for example, as will be described later, in a case where the line inclination detected in an alignment detection step is −0.04, a value (247) obtained by multiplying the shade value 248 for the nozzle 16 with the nozzle number #1 by the recorrection value (for example, 0.996) of correction information $\alpha$ (−4, 1) is a recorrected shade value. Instead of the recorrection value of the correction information $\alpha$, the recorrected shade value, which is obtained by recorrecting the shade value (corrected shade value) in the basic correction table by means of the recorrection value, may be set as the correction information. In addition, the correction information related to the discharge timing, out of correction information $\alpha$, consists of, for example, information indicating to what extent discharge timing should be hastened or delayed with respect to reference discharge timing or information indicating which drive signal should be used out of drive signals that will be described later.

FIG. 8 is a view illustrating a modification example of the alignment correction table. The alignment correction table is not limited to the above line inclination, and inclination (appropriately referred to as an X-axis rotation) of a nozzle surface of which a rotation axis is the X-axis or inclination (appropriately, referred to as a Y-axis rotation) of a nozzle surface of which a rotation axis is the Y-axis can be a type of the alignment shift. For this reason, as illustrated in FIG. 8, a two-dimensional table in which the line inclination and the X-axis rotation are correlated with each other and correction information is specified or a three-dimensional table in which the line inclination, the X-axis rotation, and the Y-axis rotation are correlated with each other and the correction information is specified can be adopted as well.

Next, adjustment processing when the recording head 4 is attached to the apparatus main body 7 or adjustment processing (identifying correction information) when the head units 3 are individually maintained and replaced in the unit holding member 8 after the printer 1 is shipped from the factory and comes into the user's hands will be described.

Figure 9:
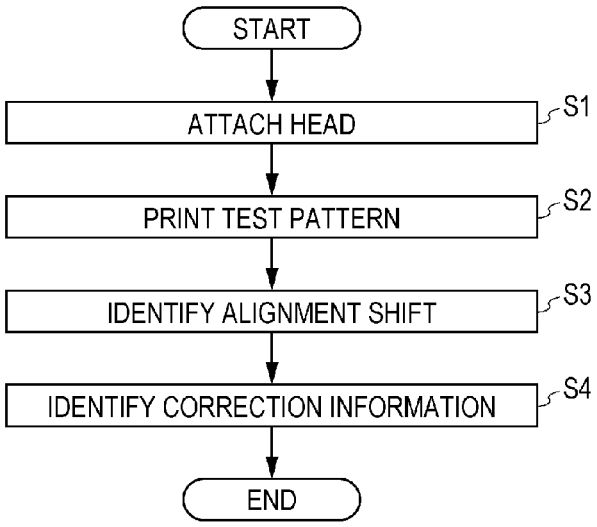
FIG. 9 is a flow chart illustrating flow of adjustment processing when attaching the liquid discharging head.

FIG. 9 is a flow chart illustrating adjustment of the printer 1. First, the recording head 4 (or the head unit 3) is attached to the apparatus main body 7 (Step S1). In this case, two ways are assumed, one being a case where the head units 3 are attached to the unit holding member 8 before shipment from the factory and the recording head 4 that is a finished product in which alignment adjustment of each of the head units 3 is completed is attached to the apparatus main body 7 as it is and the other being a case where the head units 3 are individually removed from the unit holding member 8 in order for the recording head 4, which is already attached to the apparatus main body 7, to be maintained, repaired or replaced and the head units 3 are again or newly attached to the unit holding member 8. In a case of the former, there is a possibility of occurrence of an alignment shift with respect to the apparatus main body 7 in the recording head 4 as a whole due to the attachment error of the recording head 4 to the apparatus main body 7. In addition, in a case of the latter, there is a possibility where the alignment shift occurs only for the head units 3 due to the attachment error when the head units 3 are individually replaced without removing the recording head 4 (unit holding member 8) from the apparatus main body 7 and there is a possibility where not only the alignment shift with respect to the unit holding member 8 (other head units 3) of the head units 3 but also the alignment shift with respect to the apparatus main body 7 in the recording head 4 as a whole occurs when the head units 3 are replaced and the unit holding member 8 is again attached to the apparatus main body 7 after the unit holding member 8 is removed from the apparatus main body 7. Next, once the attachment is completed, a test pattern is printed (Step S2).

Figure 10:
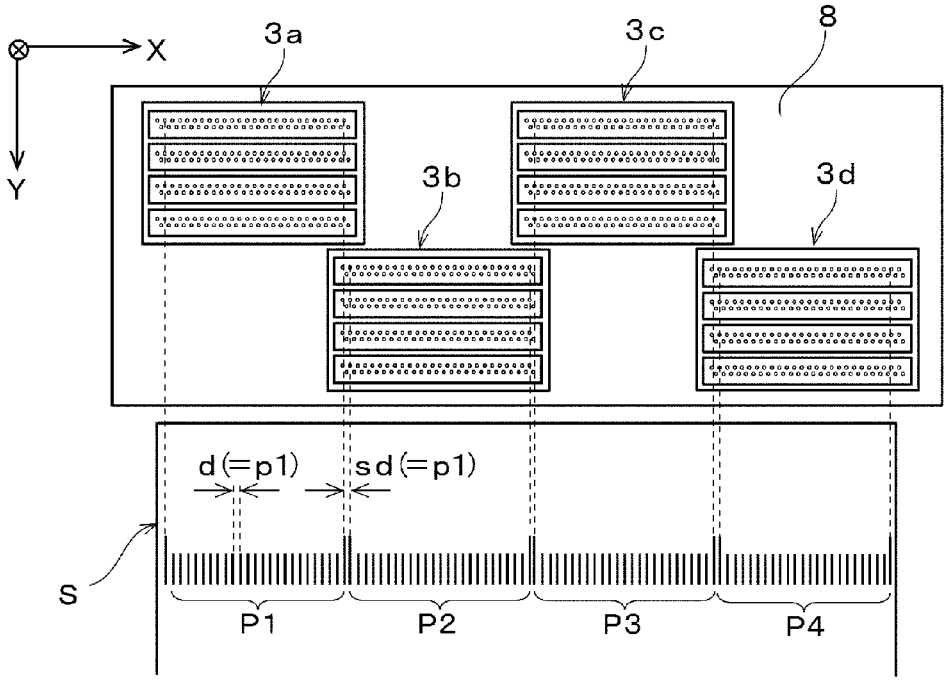
FIG. 10 is a schematic view illustrating a test pattern printing step.
Figure 11:
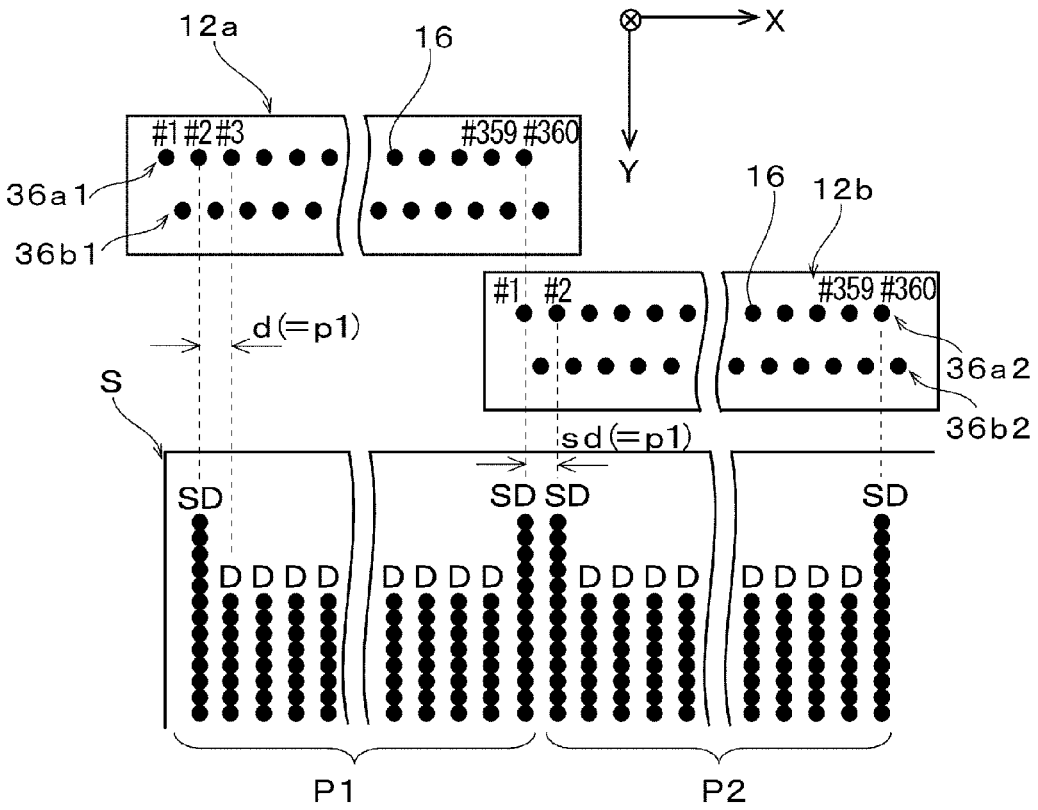
FIG. 11 is a schematic view illustrating a part of an enlarged test pattern.

FIG. 10 is a schematic view illustrating a test pattern printing step in which the test pattern is printed onto the recording medium 2. In addition, FIG. 11 is a schematic view illustrating an enlarged part of the test pattern. In the test pattern printing step, one unit pattern P is formed for each head unit 3 onto the recording medium 2. For this reason, a plurality of unit patterns P1 to P4 are lined up and formed on the recording medium 2 in the X-axis direction, which is the width direction of the recording medium 2. At this time, the unit pattern P is formed by one nozzle line (for example, one nozzle line 36*a* out of the two nozzle lines 36*a* and 36*b* for a black ink) out of eight nozzle lines of one head unit 3. As illustrated in FIG. 11, each of the unit patterns P1 to P4 is configured such that a plurality of dot lines D (including SD which will be described later), which consist of a plurality of dots arranged in parallel with each other in the Y-axis direction, are arranged in parallel with each other in the X-axis direction. In this embodiment, since the dot lines D are formed by discharging each of the inks from each of the nozzles 16 except for some nozzles (described later) out of the nozzles 16 that belong to the same nozzle line 36, each dot line D is lined up in the X-axis direction at an interval of 360 dpi, which is equal to a nozzle pitch p1 in a state where the recording head 4 and the head units 3 are accurately attached to the apparatus main body 7.

Herein, in this embodiment, the nozzle 16 provided at a position on an outer side in the width direction of the recording medium 2, that is, in an example of FIG. 11, the nozzle 16 with the nozzle number #1 positioned on one end (left end in FIG. 11) in the X-axis direction, which belongs to the nozzle line 36 (36*a*1) of the unit head 12*a* in the head unit 3, is not used in forming the dot line D since this nozzle is positioned on the outer side of the recording medium 2 in the X-axis direction at normal times (state where the alignment shift does not occur). Similarly, the nozzle 16 (not illustrated in FIG. 10) with nozzle number #360 positioned on the other end in the X-axis direction, which belongs to the nozzle line 36 in the head unit 3 is not used in forming the dot line D since this nozzle is positioned on the outer side in the width direction of the recording medium 2. In addition, any one nozzle 16 out of a set of the above overlapping nozzles that overlap each other between the neighboring head units 3 is also not used in forming the dot line D. In an example of FIG. 11, the nozzle 16 with the nozzle number #360 that belongs to the nozzle line 36*a*1 of the unit head 12*a* in a first head unit 3*a* and the nozzle 16 with the nozzle number #1 that belongs to the nozzle line 36*a*2 of the unit head 12*b* in a second head unit 3*b* next to the first head unit 3*a* are in an overlapping nozzle relationship. While the former nozzle 16 is used in forming the dot line D, the latter nozzle 16 is not used in forming the dot line D. Then, in this embodiment, out of the dot lines D that form one unit pattern P, dot lines positioned on both ends in the X-axis direction are set as reference dot lines SD, which are formed so as to be longer in the Y-axis direction than other dot lines D positioned between the dot lines.

Once the unit holding member 8 (that is, the recording head 4 as a whole) and each of the head units 3 are attached at accurate positions without being inclined with respect to the X-axis direction and the Y-axis direction, an interval d of dot lines, which configure the test pattern, in the X-axis direction is equal to the nozzle pitch p1 of the nozzle lines 36 and is 360 dpi in this embodiment. In addition, the interval d between the neighboring reference dot line SD and the dot line D and an interval sd in the X-axis direction between the reference dot lines SD formed in a portion corresponding to the junction between the head units 3 are 360 dpi, which is equal to the nozzle pitch p1. In this way, in a case where each of the head units 3 is accurately attached to the unit holding member 8 and the unit holding member 8 (recording head 4) is accurately attached to the apparatus main body 7, the dot lines D and SD of the test pattern are lined up at an equal interval in the X-axis direction.

Figure 12:
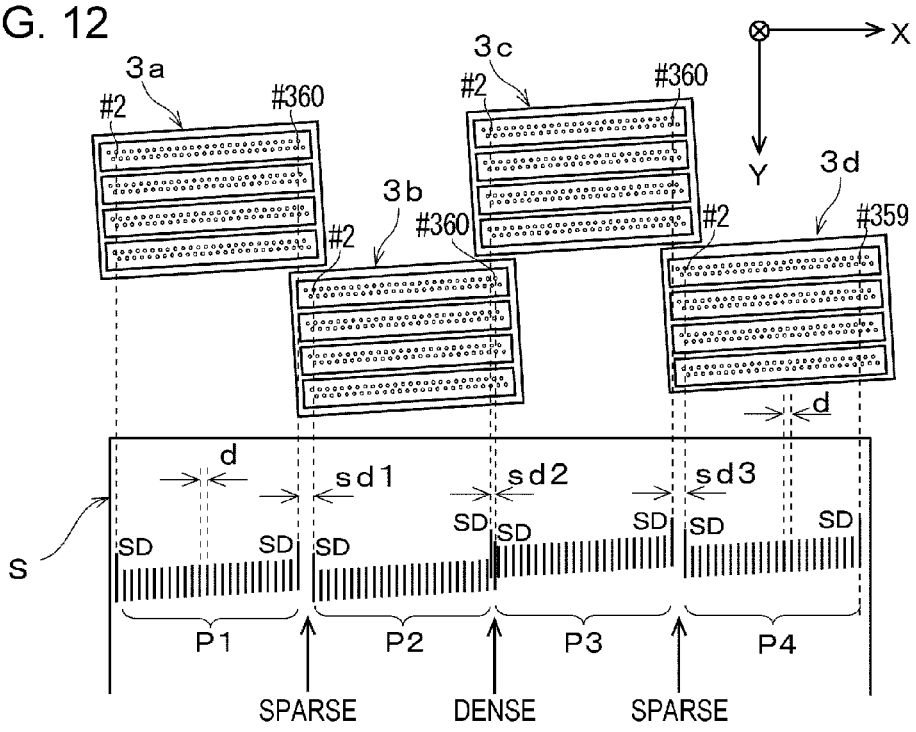
FIG. 12 is a schematic view illustrating the test pattern printing step.

FIG. 12 is a schematic view illustrating a case where each of the head units 3 is accurately attached to the unit holding member 8 without the alignment shift and a case where the unit holding member 8 of the recording head 4 is inclined and attached with respect to the apparatus main body 7. To make description easier to understand, FIG. 12 illustrates a state where the unit holding member 8 is much more inclined than actual inclination which is likely to occur (the same is applied to inclination and a position shift in an example that will be described hereinafter). As illustrated in FIG. 12, inclination of dot line array and sparseness and denseness between dot lines occur in the test pattern printed on the recording medium 2 in a case where the nozzle lines 36 are inclined with respect to the X-axis direction and the Y-axis direction (in a case of the line inclination in which the nozzle lines 36 are inclined counterclockwise about the Z-axis in an example of FIG. 12) when the unit holding member 8 is attached to the apparatus main body 7. That is, the lineup of the dot lines of each of the unit patterns P1 to P4 is oblique (rising to the right in the example of FIG. 12) with respect to the X-axis direction according to the inclination of the unit holding member 8. In addition, an interval sd1 between the reference dot line SD formed by the nozzle 16 with the nozzle number #360 in the first head unit 3*a* in FIG. 12 and the reference dot line SD formed by the nozzle 16 with a nozzle number #2 in the second head unit 3*b* next to the first head unit 3*a* is wider than the nozzle pitch p1 (sd1>p1) (sparse). Similarly, an interval sd3 between the reference dot line SD formed by the nozzle 16 with the nozzle number #360 in a third head unit 3*c* and the reference dot line SD formed by the nozzle 16 with the nozzle number #2 in a fourth head unit 3*d* next to the third head unit 3*c* is wider than the nozzle pitch (sd3>p1) (sparse). On the other hand, an interval sd2 between the reference dot line SD formed by the nozzle 16 with the nozzle number #360 in the second head unit 3*b* and the reference dot line SD formed by the nozzle 16 with the nozzle number #2 in the third head unit 3*c* next to the second head unit 3*b* is narrower than the nozzle pitch (sd2<p1) and the dot lines SD are formed so as to overlap (or a positional relationship of the both in the X-axis direction is reversed compared to a normal case) each other (dense). For this reason, a region that appears dark because of being formed by the reference dot lines SD becoming adjacent to or overlapping each other and a region that appears light because of the interval between the reference dot lines SD, which is wider than the nozzle pitch, are alternately formed in the X-axis direction once the printed test pattern is seen as a whole.

Similarly, also in a case where the line inclination in which the nozzle lines 36 are inclined clockwise about the Z-axis, the inclination of the dot line array and the sparseness and denseness between the dot lines occur in the test pattern. In this case, an inclined direction is falling to the right and a sparseness and denseness relationship is also in reverse compared to the above case where the nozzle lines 36 are inclined counterclockwise. That is, the interval sd1 and the interval sd3 are narrower than the nozzle pitch (dense) and the interval sd2 is wider than the nozzle pitch. In addition, as an angle of inclination becomes larger, the size of a dense region and the size of a sparse region become larger. Furthermore, the interval d of the dot lines in the X-axis direction becomes smaller than the nozzle pitch p1 of the nozzle lines 36 as the angle of inclination becomes larger. In this way, the inclination (line inclination) of the recording head 4 with respect to the apparatus main body 7 and the degree of inclination (inclination angle) can be detected as the alignment shift based on the inclination of the dot line array and a position at which the sparseness and denseness occur or the interval of the dot lines in the test pattern.

Figure 13:
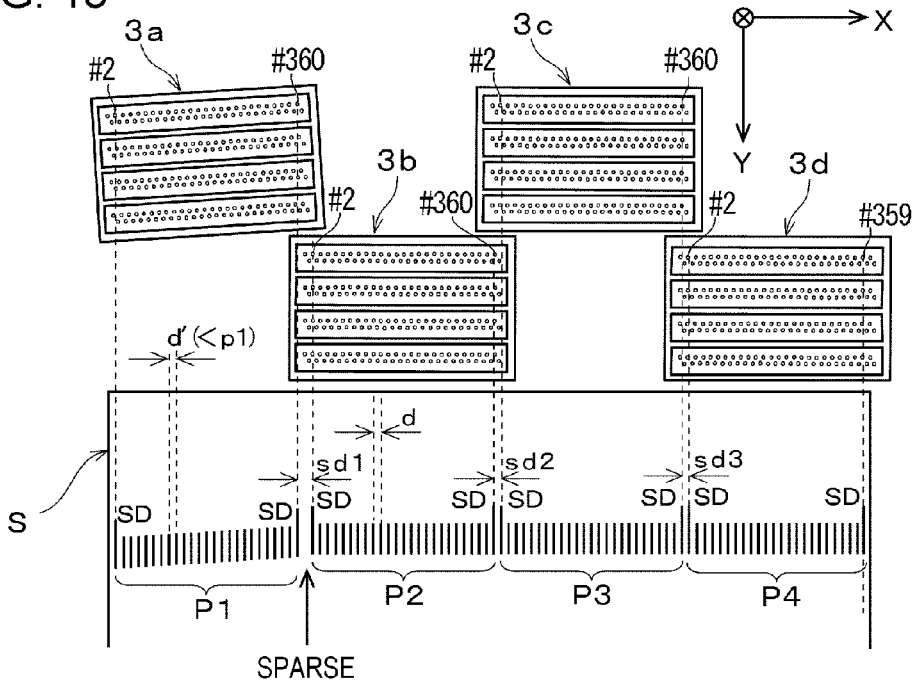
FIG. 13 is a schematic view illustrating a case where head units are inclined and attached with respect to a unit holding member.

FIG. 13 is a schematic view illustrating a case where the unit holding member 8 is accurately attached to the apparatus main body 7 and a case where the head unit 3 is inclined and attached with respect to the unit holding member 8. In this example, a case where counterclockwise line inclination occurs in the first head unit 3*a* as a result of the first head unit 3*a* being inclined and attached with respect to the unit holding member 8 is assumed. Other head units 3*b* to 3*d* are attached normally to the unit holding member 8. In this case, while the dot lines D and SD in the unit patterns P2 and P3 printed by the head units 3*b* to 3*d* excluding the first head unit 3*a* are lined up in the X-axis direction, the dot line D in the unit pattern P1 printed by the first head unit 3*a* is inclined and lined up with respect to the X-axis direction (rising to the right in an example of FIG. 13). In addition, the interval sd2 between the reference dot lines SD, which corresponds to a junction between the second head unit 3*b* and the third head unit 3*c* and the interval sd3 between the reference dot lines SD, which corresponds to a junction between the third head unit 3*c* and the fourth head unit 3*d* are equal to the nozzle pitch (sd2=sd3=p1). On the other hand, the interval sd1 between the reference dot lines SD, which corresponds to a junction between the first head unit 3*a* and the second head unit 3*b* next to the first head unit 3*a* is wider than the nozzle pitch (sd1>p1) (sparse). Furthermore, while the interval d of the dot lines in the X-axis direction in each of the unit patterns P2 and P3 printed by the head units 3*b* to 3*d* is equal to the nozzle pitch p1 (d=p1), an interval d' of the dot lines in the X-axis direction in the unit pattern P1 printed by the first head unit 3*a* is narrower than the interval d of the dot lines in the X-axis direction in the unit patterns P2 and P3 (d'<p1).

On the contrary, in a case where the counterclockwise line inclination occurs in the first head unit 3*a*, the inclined direction of the lineup of the dot lines D in the unit pattern P1 is in reverse (falling to the right) to the example of the FIG. 13 and the interval sd1 of the reference dot lines SD, which corresponds to the junction between the first head unit 3*a* and the second head unit 3*b* next to the first head unit 3*a*, is narrower than the nozzle pitch (dense). In this way, also in a case where the head unit 3 is inclined and attached with respect to the unit holding member 8, the head unit 3 which is inclined with respect to the unit holding member 8 can be identified and the line inclination of the nozzle lines 36 of the head unit 3 and the degree of inclination (inclination angle) can be detected as the alignment shift based on the inclination of the lineup of the dot lines D in the test pattern, a position at which the sparseness and denseness occur in the reference dot lines SD of the test pattern, and the interval of the dot lines d.

In a case where the head units 3 are inclined and attached with respect to the unit holding member 8 when the recording head 4 is inclined and attached with respect to the apparatus main body 7, the lineup of each of the dot lines D in each unit pattern is inclined as a whole with respect to the X-axis and the interval d of the dot lines D as a whole is narrower than the nozzle pitch as well. Among the aforementioned, the inclination angle of the unit pattern printed by the head units 3 which are inclined and attached with respect to the unit holding member 8 and the interval d of the dot lines D are different from those of the unit pattern printed by other head units 3. Therefore, also in this case, the inclination of the recording head 4 with respect to the apparatus main body 7, the degree of inclination, and the head unit 3 which is inclined with respect to the unit holding member 8 can be identified and each of the line inclination and the degree of inclination of the head unit 3 can be detected as the alignment shift based on the lineup of the dot lines D in the test pattern and the interval d of the dot lines (sparseness and denseness of the reference dot lines SD) in the test pattern.

Figure 14:
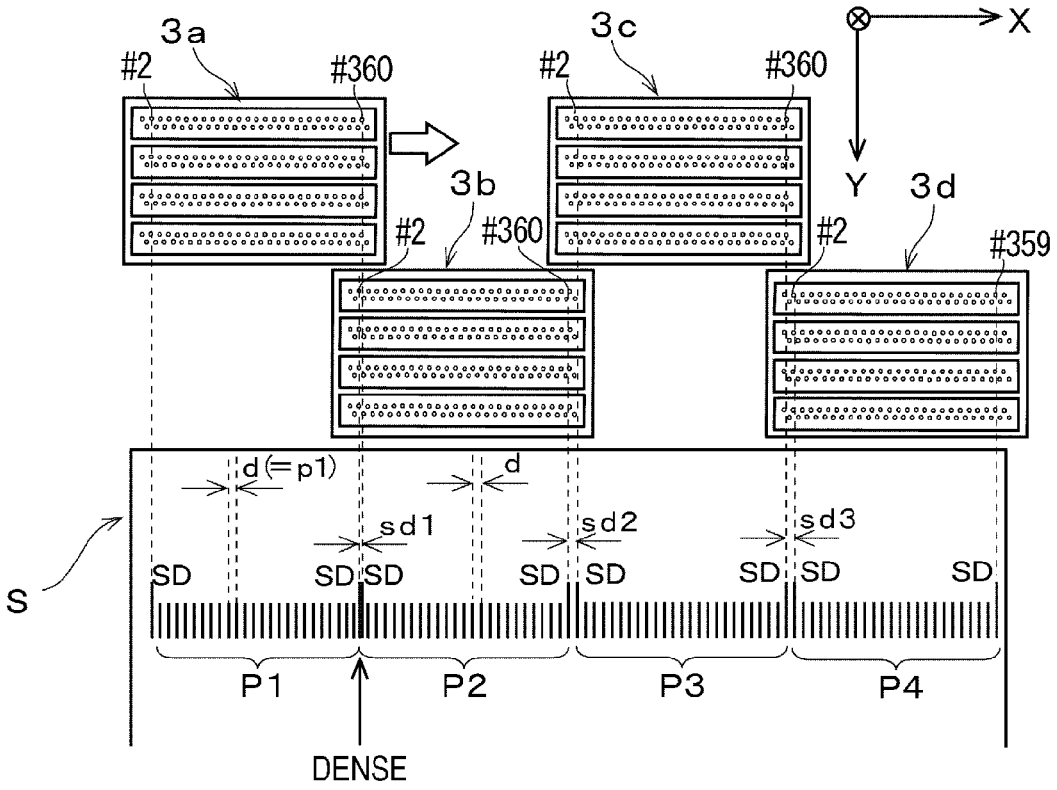
FIG. 14 is a schematic view illustrating a case where the head units are attached to the unit holding member in a state of a relative position shift between the head units.

FIG. 14 is a schematic view illustrating a case where the unit holding member 8 is accurately attached to the apparatus main body 7 and a case where the head units 3 are attached to the unit holding member 8 in a state of a relative position shift between the head units 3. In this example, a case where the first head unit 3*a* is attached further to a second head unit 3*b* side than the original position in a state of the attachment position shift of the first head unit 3*a* in the X-axis direction is assumed. Other head units 3*b* to 3*d* are attached normally to the unit holding member 8. In this case, only the interval sd1 between the reference dot lines SD, which corresponds to the junction between the first head unit 3*a* and the second head unit 3*b* is narrower than the nozzle pitch (sd1<p1) (dense). In addition, the interval d of the dot lines in the X-axis direction in each of the unit patterns P1 to P3 printed by the head units 3*a* to 3*d* is equal to the nozzle pitch p1 (d=p1). On the contrary, in a case where the first head unit 3*a* is attached further to a side opposite to the second head unit 3*b* side than the original position in a state of the attachment position shift of the first head unit 3*a* in the X-axis direction, only the interval sd1 between the reference dot lines SD, which corresponds to the junction between the first head unit 3*a* and the second head unit 3*b*, is wider than the nozzle pitch (sd1>p1) (sparse).

In this way, based on the interval (sparseness and denseness) of the reference dot lines SD in the test pattern, the head unit 3 in which the position shift occurs is identified and the degree of the position shift (position shift amount) of the head unit 3 in the X-axis direction can be detected as the alignment shift also in a case where the head unit 3 is attached in a state of the relative position shift of the head unit 3 in the X-axis direction. Furthermore, in a case where the attachment position of the head unit 3 is shifted in the Y-axis direction, the unit pattern printed by the head unit 3 in the test pattern is shifted in the Y-axis direction with respect to the unit pattern printed by other head units 3. Thus, also in this case, based on the positional relationship of each unit pattern in the Y-axis direction, the head unit 3 in which the position shift occurs can be identified and the degree of the position shift (position shift amount) of the head unit 3 in the Y-axis direction can be detected as the alignment shift.

In a case where the head unit 3 is attached with respect to the unit holding member 8 in a state of the position shift of the head unit 3 in the X-axis direction or the Y-axis direction and thus a relative position shift between other head units 3 occurs when the recording head 4 is inclined and attached with respect to the apparatus main body 7, each lineup of the dot lines D in each unit pattern of the test pattern is inclined with respect to the X-axis direction and the interval d of the dot lines D as well is narrower than the nozzle pitch a whole. Furthermore, although the sparseness and denseness occur in the interval sd between the reference dot lines SD, which corresponds to the junction of each of the head units 3, according to the inclination of the recording head 4 with respect to the X-axis direction, the interval sd between the reference dot lines SD, which corresponds to a junction between the head unit 3 in which the relative position shift occurs and the head unit next to this head unit 3, is different from the interval sd between the reference dot lines SD, which a portion corresponding to other junction, according to a shift amount of the head unit 3 in which the position shift occurs. Therefore, also in this case, based on the interval d of the dot lines D in the test pattern and a position at which the interval (sparseness and denseness) of the reference dot lines SD is generated, the head unit 3 in which the position shift occurs can be identified and the degree of the position shift (position shift amount) of the head unit 3 in the X-axis direction can be detected as the alignment shift.

As in the above description, a variety of alignment shifts can be detected according to the test pattern. Without being limited to the test pattern described in this embodiment, test patterns in a variety of known forms can be adopted insofar as the alignment shift can be detected.

Next, the alignment shift is identified based on the printed test pattern (Step S3). For example, an image of the test pattern at higher resolution than the printing resolution is read by the scanner 63 and the read image (hereinafter, test pattern image) is acquired by the computer 48 as a type of alignment information in the invention via the scanner driver. Then, as described above, the alignment shift of the recording head 4 as a whole attached to the apparatus main body 7 or the individual alignment shift of the head unit 3 is identified based on the acquired test pattern image. This alignment shift may be identified by the printer driver 53 in the computer 48 and may be identified by the CPU 55 or the image processing circuit 54 of the printer 1 after the test pattern image is output to the printer 1. In a case of the latter, the input/output interface 58 corresponds to a type of the input unit in the invention since the test pattern image, which is the alignment information, is input into the printer 1 through the input/output interface 58. In either case, based on the inclination of the array of the dot lines in the test pattern image, the interval of the dot lines, or the position of the sparseness and denseness, the alignment shift of the unit holding member 8 (recording head 4) with respect to the apparatus main body 7 or the alignment shift of each of the head units 3 in the unit holding member 8 is identified as described above.

Figure 15:
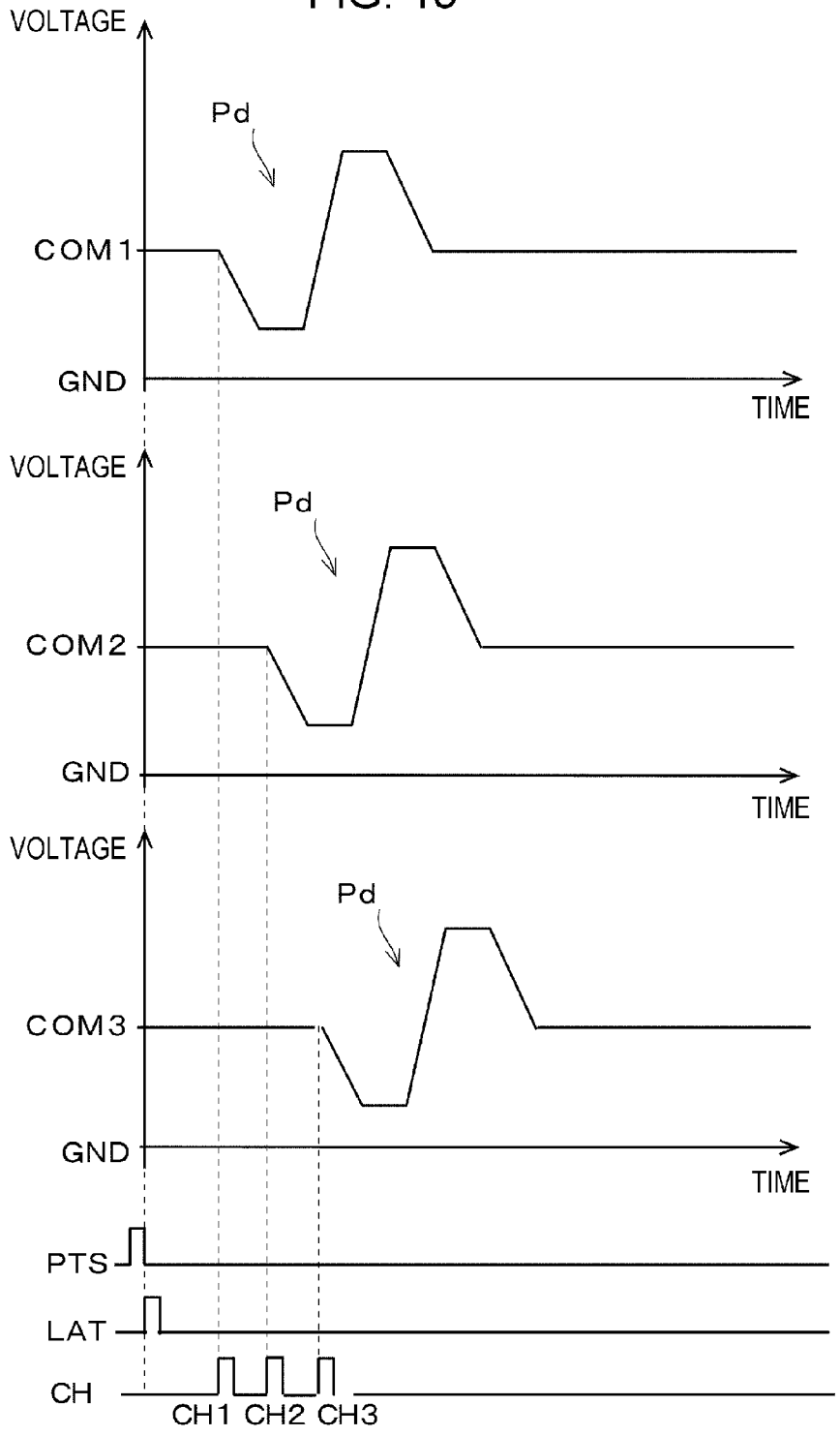
FIG. 15 is a waveform diagram illustrating an example of a drive pulse included in a drive signal.
Figure 16:
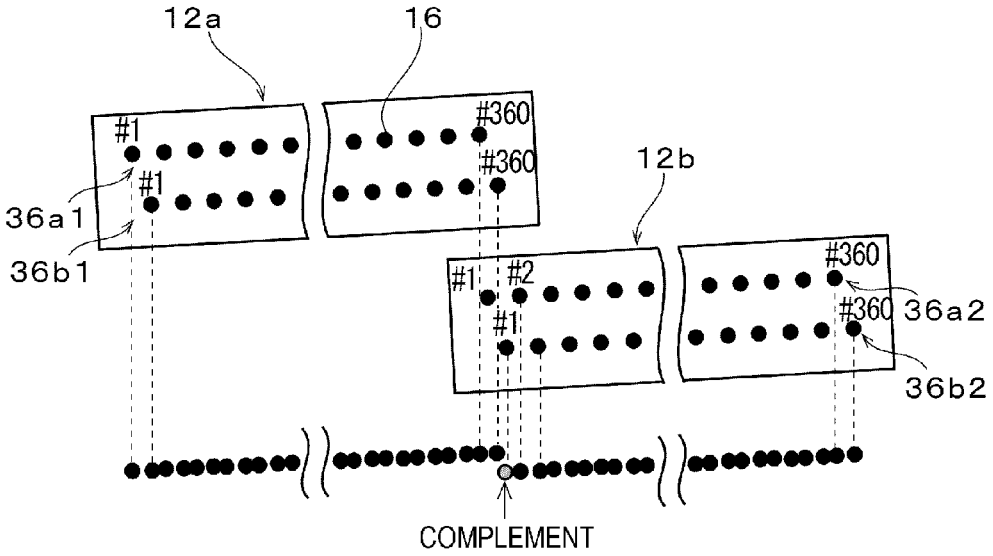
FIG. 16 is a schematic view illustrating array of dots before correction in a case where the line inclination occurs in the recording head.

FIG. 15 is a waveform diagram illustrating an example of a configuration of a plurality of drive signals COM of which drive pulse generation timing is different from each other. In addition, FIG. 16 is a schematic view illustrating the array of the dots before correction in a case where the line inclination occurs in the recording head 4. Once the alignment shift is identified, the correction information according to the alignment shift is identified (Step S4). For example, as illustrated in FIG. 16, in a case where the alignment shift is identified as the line inclination in which the recording head 4 is inclined counterclockwise about the Z-axis with respect to the apparatus main body 7, the correction information $\alpha$ according to the degree of line inclination is identified for each of the nozzles 16 with reference to the alignment correction table. In this way, since the alignment shift is identified from the alignment information and the correction information is identified from the identified alignment shift, it can be said that the correction information is indirectly identified from the alignment information. As for the correction information related to the discharge timing for each of the nozzles 16 out of the correction information $\alpha$, the drive signal generating circuit 57 in this embodiment is configured such that a plurality of drive signals COM1 to 3, of which generation timing of a drive pulse Pd is different from each other, are generated as illustrated in FIG. 15. Then, information for identifying the drive signal COM to be used in the printing operation for each of the nozzles 16 according to the angle of the above line inclination can be adopted as the correction information related to the above discharge timing. By applying this correction information to the printing operation, the landing position of the ink in the Y-axis direction, which is discharged from each of the nozzles 16 of the nozzle line 36 discharging the same color of ink, is organized as much as possible at a time of printing operation. Although a configuration in which three different drive signals in terms of generation timing are selected in this embodiment, the invention is not limited to this configuration. In addition, information indicating to what extent the discharge timing should be hastened or delayed from a discharge timing reference value can be adopted as the correction information related to the discharge timing and a configuration where timing at which the drive pulse is applied to the piezoelectric element 25 is hastened or delayed based on this information can also be adopted.

As for the recorrection value for the shade value (corrected shade value) for each of the nozzles 16 out of the correction information in the alignment correction table, recorrection values for the shade values, which make the sparseness and denseness less conspicuous, are identified (such recorrection values are determined in advance in the alignment correction table. Hereinafter, the same is applicable) since the interval of each of the dots is narrower than the nozzle pitch or, on the contrary, is wider than the nozzle pitch and thereby the sparseness and denseness occur as illustrated in FIG. 16 in a case where the line inclination occurs. That is, for example, the recorrection value to increase the shade value is identified for one of the nozzles 16 that form dots on both sides of a blank, a portion corresponding to "sparse" in which a dot interval is relatively wide, in the X-axis direction. In conjunction with this, the recorrection value to decrease the shade value is identified for one of the nozzles 16 that form dots on a portion corresponding to "dense" in which the dot interval is relatively narrow. In addition, since the sparseness and denseness of the dots occur also in portions corresponding to the junctions of the head units 3, the recorrection value for eliminating these sparseness and denseness are identified. For example, since an interval between the dot formed by the nozzle 16 with the nozzle number #360 in the first head unit 3*a* and the dot formed by the nozzle 16 with the nozzle number #2 in the second head unit 3*b* next to the first head unit 3*a* is wider (sparse) than dot intervals in other portions in FIG. 16, the recorrection value to relatively increase the shade value for at least one of these nozzles 16 is identified. Instead, in this embodiment, the nozzle 16 with the nozzle number #360 in the first head unit 3*a* and the nozzle 16 with the nozzle number #1 in the second head unit 3*b* are in the overlapping nozzle relationship with each other and information identifying that the latter nozzle 16 which is not used at normal times is also used in discharging (complement discharging) may be the correction information as well. That is, the correction information that discharging by the nozzle 16 with the nozzle number #1 in a nozzle line 36*b*2 in the second head unit 3*b* is complemented is identified. In short, any correction information may be used insofar as an ink landed amount rises in a portion that is sparse. As in the above description, by reflecting the correction information identified from the alignment correction table based on the alignment information in control of the printing operation, the blank in the portion corresponding to the junctions of the head units 3 is made less conspicuous and a white streak-like banding is prevented from being generated in the print image.

On the contrary, in a case where the interval of the dots in a junction portion is narrower (dense) than the dot interval, the recorrection value to relatively decrease the shade value is identified for at least one of the nozzles 16 corresponding to these junction portions. Instead, the correction information identifying one of these nozzles 16 is not used (skipped) in the printing operation (that is, the shade value is set to 0) may be adopted. In short, the correction information for cutting down the ink landed amount in a portion that is dense may be adopted. By reflecting this correction information in the printing operation, the occurrence of ink density becoming higher in the portion corresponding to the junction of the head unit 3 is reduced and thus the dark streak-like banding is prevented from being generated in the print image.

In this embodiment, information indicating that the nozzle 16 with the nozzle number #1 in the first head unit 3*a* and the nozzle 16 with the nozzle number #360 in the fourth head unit 3*d* as well, which are not used at normal times in this embodiment, are used in discharging (complement discharging) may be identified as the correction information since a printable width (area in which the ink can be landed onto the recording medium 2) in the X-axis direction becomes narrow depending on the degree of inclination in a case where the line inclination occurs in the recording head 4 as a whole. In other words, the number of nozzles to be used changes (rises). Accordingly, the printable width in the X-axis direction can be kept within an appropriate area. Instead, in a case where the number of nozzles cannot be increased (in a case of a configuration where the spare nozzles 16 that are not used in discharging at normal times do not exist), a configuration where correction to increase a discharge amount for the nozzle 16 positioned at a nozzle group end (including a plurality of nozzle lines), which discharges the same color of ink, in the X-axis direction is performed can also be adopted. Accordingly, the printable width in the X-axis direction can be apparently kept within an appropriate area.

In addition, in a configuration where the alignment correction table, in which the line inclination and the X-axis rotation are correlated with each other as illustrated in FIG. 8 and correction information β is specified, and the alignment correction table, in which the line inclination, the X-axis rotation, and the Y-axis rotation are correlated with each other and the correction information is specified, exist as the alignment correction tables, the correction information is identified from these tables in a case where such an alignment shift is identified. For example, in a case where the nozzle surface of each of the head units 3 is inclined with respect to a medium supporting surface of the medium supporting portion 6 by attaching the recording head 4 to the apparatus main body 7 in a state where the recording head 4 is inclined about the X-axis, an image is printed onto the recording medium 2 such that the overall print image is shifted in the Y-axis direction. In this case, the correction information for delaying or hastening the discharge timing of the nozzle 16 according to the alignment shift is identified. In addition, in a case where the recording head 4 is attached to the apparatus main body 7 in a state where the recording head 4 is inclined about the Y-axis and the nozzle surface of each of the head units 3 is inclined with respect to the medium supporting surface of the medium supporting portion 6, an image is printed onto the recording medium 2 such that the overall print image is shifted in the X-axis direction. In such a case, the correction information for changing allocation of the nozzle 16 to each pixel of the image data according to the alignment shift is identified.

Without being limited to the correction information in the alignment correction table, the image processing circuit 54 and the CPU 55 may perform the correction processing according to the alignment shift apart from correction information. In addition, without applying the correction information specified in the alignment correction table as it is as the correction information, the image processing circuit 54 and the CPU 55 may perform calculation to optimize the correction information. For example, the correction information can be weighted by multiplying a coefficient according to environment information including temperature and humidity or a type of the recording medium 2.

Figure 17:
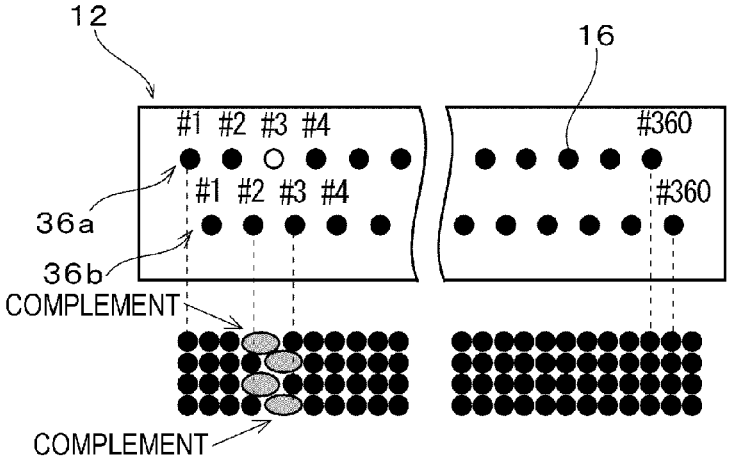
FIG. 17 is a schematic view illustrating array of dots in complementary control for dot omission.
Figure 18:
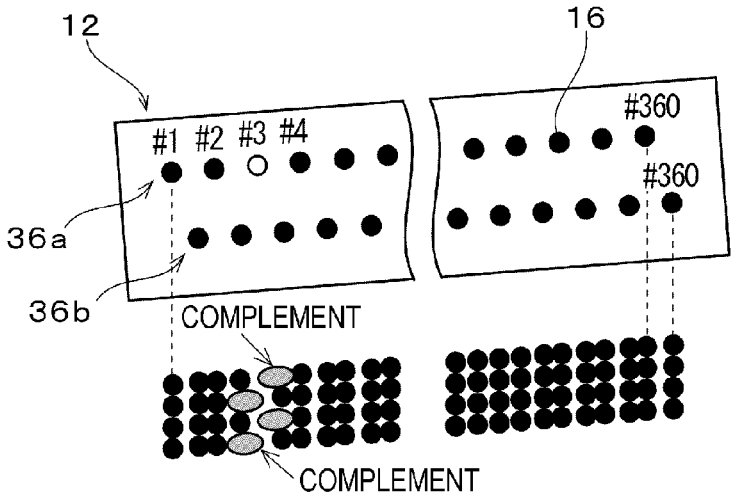
FIG. 18 is a schematic view illustrating the array of dots in the complementary control for dot omission.

FIG. 17 and FIG. 18 are schematic views illustrating the array of dots in complementary control for dot omission. FIG. 17 illustrates a state where the alignment shift does not occur and FIG. 18 illustrates a state where the line inclination of the alignment shift occurs. For example, in a case where there is the nozzle 16 (hereinafter, referred to as an omitted nozzle) that does not discharge the ink out of the nozzles 16 in the recording head 4 (so-called, nozzle omission), the nozzle 16 (second nozzle) near the omitted nozzle 16 (first nozzle) performs control for complementing. In such a configuration, second nozzle complementary correction information related to the complementary control can also be included as the correction information. In an example of FIG. 17, the nozzle 16 with the nozzle number #3 in the nozzle line 36*a* is the omitted nozzle (first nozzle) (nozzle indicated in white), and complementation is performed such that a region, in which dots that should be formed originally by the omitted nozzle, is covered with ink by forming dots larger than those at normal times with the nozzle 16 (second nozzle) with the nozzle number #2 in the nozzle line 36*b* and the nozzle 16 (second nozzle) with the nozzle number #3 in the nozzle line 36*b* instead of the omitted nozzle. In such a configuration, in addition to the correction information corresponding to normal discharging time (discharging time in a case where the complementary control is not performed), the complementary correction information corresponding to the complementary control is separately specified in the alignment correction table for the second nozzles for the complementary control. Then, the recorrection value to make the sparseness and denseness less conspicuous according to the degree of line inclination is identified since the sparseness and denseness occur in the dots in a case where the line inclination occurs in the recording head 4 or in a case where the line inclination occurs in the head units 3 as illustrated in FIG. 18. That is, the recorrection value to relatively decrease the shade value at a time of complementary control by the second nozzles for the complementary control is identified as the complementary correction information in a case of "sparse" in which the dot interval is relatively wide and the recorrection value to relatively increase the shade value at a time of complementary control by the second nozzles for the complementary control is identified as the complementary correction information in a case of "dense" in which the dot interval is relatively narrow. Accordingly, the occurrence of ink density of a complemented portion becoming higher or lower than that of other portion is reduced by reflecting the complementary correction information in the complementary control and more appropriate complementary control for dot omission is possible also in a case where the alignment shift occurs.

In this way, the correction information according to the alignment shift of each of the nozzles 16 is identified. Herein, unlike the test pattern (test pattern for identifying the density unevenness) for acquiring the correction information for each nozzle, the test pattern is not required to be printed by the entire nozzles 16 and a plurality of pages are not required to be printed for each of a plurality of operation modes or for each temperature since it is sufficient for the test pattern for identifying the alignment shift to allow identifying the alignment shift of the recording head 4 or the head units 3. Furthermore, the test pattern may not have to be a pattern that consumes a large amount of ink such as so-called solid shot. For this reason, effort and time taken for printing can be lowered compared to a case where the test pattern for identifying the density unevenness is printed. Then, once the user or a service person performs work (work of inputting the alignment information) of printing the test pattern for identifying the alignment shift and incorporating the printing results into the computer 48 and the printer 1 as the test pattern image by means of the scanner or the like onto recording paper or the like with the printer 1 in a series of the above steps, the alignment shift and the correction information are automatically identified by the printer driver 53 and the CPU 55 based on the test pattern image. For this reason, effort and time taken for reacquiring the correction information for the entire nozzles 16 of the recording head 4 from the test pattern can be lowered by the test pattern for identifying the density unevenness being printed by the entire nozzles 16. Accordingly, a burden of adjustment work conducted after the recording head 4 or the head unit 3 is attached or replaced to the user or the service person can be alleviated in a case where the recording head 4 is attached to the apparatus main body 7 in a stage when the printer 1 comes into the user's hands, in a case where the recording head 4 temporarily removed from the apparatus main body 7 due to maintenance or failure or the recording head 4 is replaced with a new recording head, or in a case where the head units 3 are individually attached to or detached from the unit holding member 8.

Then, correction is performed for the control of the printing operation (ink discharge control by the recording head 4) based on the identified correction information. Specifically, the image processing circuit 54 allocates the nozzle 16 to each pixel of the CMYK image data obtained by the color conversion processing from the printing data (image data) received from an external device including the computer 48. In other words, each nozzle 16 that forms a dot that configures each pixel of image data is determined. At this time, depending on the alignment shift, the pixel is allocated to the nozzle 16 that is not used in the printing operation at normal times and the nozzle 16 is set as the discharge nozzle or the pixel is not allocated to the nozzle 16 that is used in the printing operation at normal times and the nozzle 16 is set as the non-discharge nozzle as described above. Then, the image processing circuit 54 reflects the recorrection value identified in the above correction information identifying step and corrects a density shade value of the nozzle 16 in the basic correction table. Then, the halftone processing and the rasterization processing is performed based on the shade value after correction and the obtained raster data is output to the head controller 61. Out of the correction information identified in the correction information identifying step, the correction information related to the discharge timing is also output to the head controller 61. The head controller 61 performs control of selectively applying the drive pulse that is included in the drive signal COM output from the drive signal generating circuit 57 to the piezoelectric element 25 corresponding to each of the nozzles 16 based on the raster data and the correction information related to the discharge timing. Accordingly, the printing operation (liquid discharging operation) is performed by the recording head 4 while reflecting the above correction information. As a result, the density unevenness or the ruled line shift is prevented from being caused by the alignment shift in the print image, which is a result of the printing operation. Accordingly, a decline in quality (image quality) of the print image is prevented.

Although a configuration in which the printer driver 53 and the like identify the alignment shift by incorporating the recording medium 2, on which the test pattern is printed, into the computer 48 and the like by means of the scanner 63 connected to the computer 48 as the test pattern image has been described in the above embodiment, the invention is not limited to this configuration. For example, the printer 1 may be a multi-function device having a function of a scanner as the input unit and a configuration in which the CPU 55 or the image processing circuit 54 identifies the alignment shift by incorporating the recording medium 2, on which the test pattern is printed, into the printer 1 by means of the scanner as the test pattern image can be adopted.

In addition, for example, a configuration in which imaging means, such as a CCD camera, images the nozzle surface of the recording head 4 attached to the apparatus main body 7 and the CPU 55 or image processing circuit 54 identifies the alignment shift based on the captured image (a type of the alignment information) of the nozzle surface can be adopted. Instead, a configuration in which the alignment shift is identified by a sensor or the like, which detects the posture of the nozzle surface of the recording head 4, can be adopted as well. In this case, information output from the sensor is a type of the alignment information in the invention. Furthermore, a configuration in which the alignment shift is identified by the user or the like based on the actually printed test pattern can be adopted as in a second embodiment that will be described below.

Figure 19:
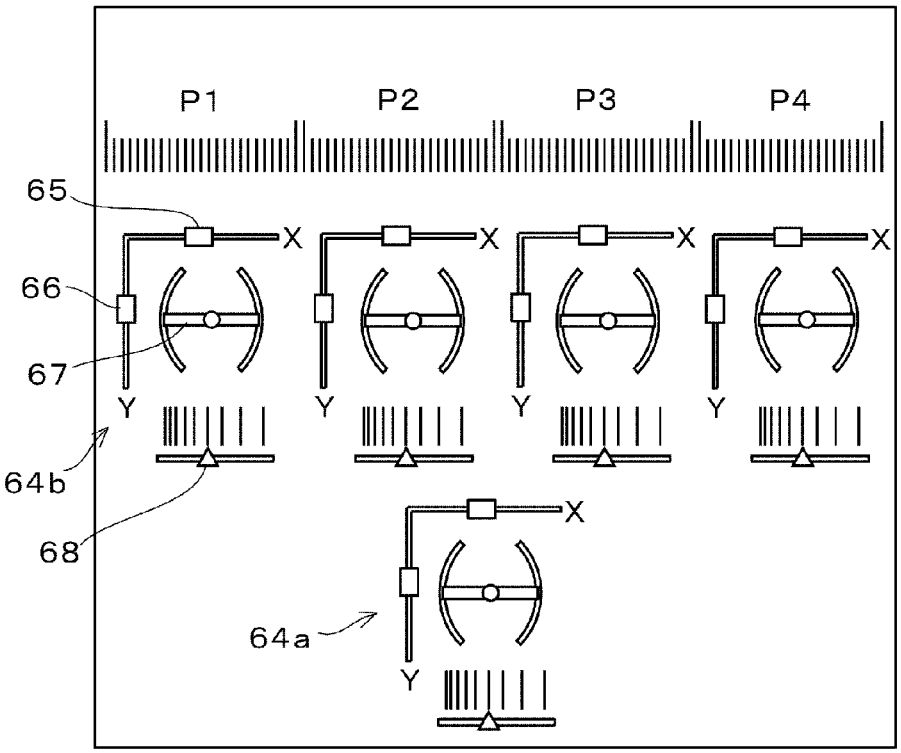
FIG. 19 is a view illustrating an example of a user interface image for allowing a user to identify an alignment shift in a second embodiment.
Figure 20:
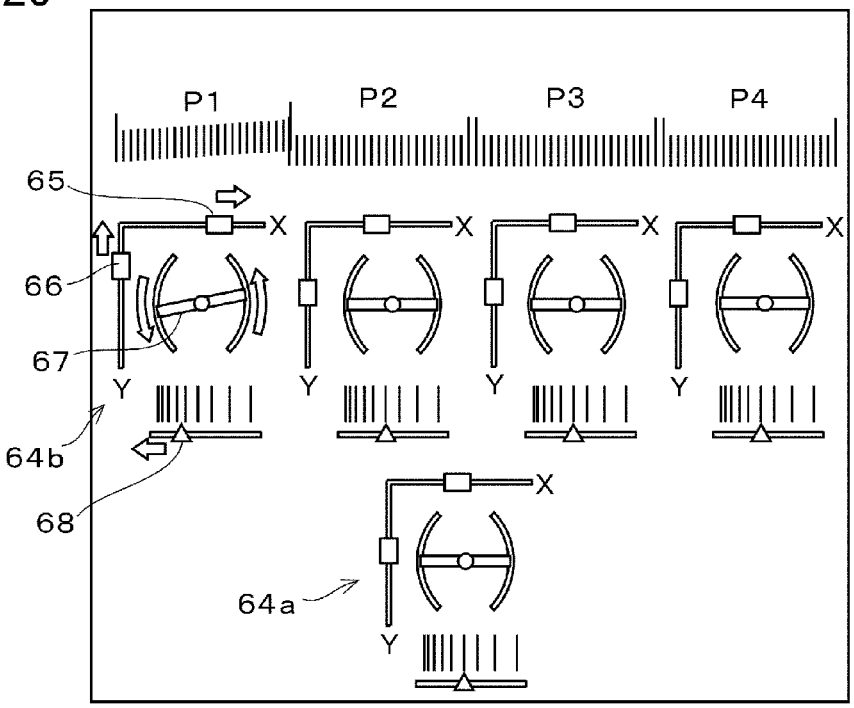
FIG. 20 is a view illustrating an example of the user interface image for allowing the user to identify the alignment shift in the second embodiment.

FIG. 19 and FIG. 20 are views illustrating an example of a user interface image (hereinafter, GUI) for the user to identify the alignment shift in the second embodiment of the invention. Such a GUI is displayed by a display device (not illustrated) or the like connected to the display unit 60 of the printer 1 and the computer 48. An adjusting unit 64 for adjusting a figure that represents the test pattern (unit patterns P1 to P4) and the position and the angle of each unit pattern is displayed in the GUI in this embodiment. The adjusting unit 64 consists of an overall adjusting unit 64*a* for adjusting the entire test pattern and an individual adjusting unit 64*b* for individually adjusting the unit pattern. Each adjusting unit 64 is provided with an X-axis slider 65 for adjusting the position of the pattern in the X-axis direction, a Y-axis slider 66 for adjusting the position of the pattern in the Y-axis direction, an inclination slider 67 for adjusting the inclination of the pattern, and a pitch slider 68 for adjusting the pitch of the dot lines. While referring to the actual test pattern printed on the recording medium, the user adjusts each of the sliders 65 to 67 via an input device such as the button operation receiving unit 59 or a mouse (not illustrated) such that the pattern becomes similar to the actual test pattern. For example, as illustrated in FIG. 20, once the X-axis slider 65 of the unit pattern P1 is caused to slide to the right along a guide that extends in the X-axis direction, the unit pattern P1 can be moved to the right (unit pattern P2 side). In addition, once the Y-axis slider 66 of the unit pattern P1 is caused to slide upward along a guide that extends in the Y-axis direction, the unit pattern P1 can be moved upward. Similarly, once the inclination slider 67 is caused to slide (rotate) counterclockwise along arcuate guides, the unit pattern P1 is inclined counterclockwise with respect to the X-axis in response to the sliding. Furthermore, once the pitch slider 68 is caused to slide to a side (the left in FIG. 20) on which the pitch of the displayed pattern becomes narrower along the guide, the pitch of the dot lines in the unit pattern P1 becomes narrower.

In this embodiment, the alignment shift is identified by the content adjusted and set in this way by the user or the service person with the GUI being input into the printer 1 as the alignment information based on this alignment information. For this reason, even in an environment where there is no input unit such as the scanner 63 to incorporate the test pattern as the image, the alignment shift can be identified. Without being limited to a method in which the alignment shift is identified by the user or the like using the GUI, a method for identifying the alignment shift by displaying some examples of test patterns in which the alignment shift occurs and by selecting a test pattern that is similar to the actually printed test pattern from the examples can be adopted.

Figure 21:
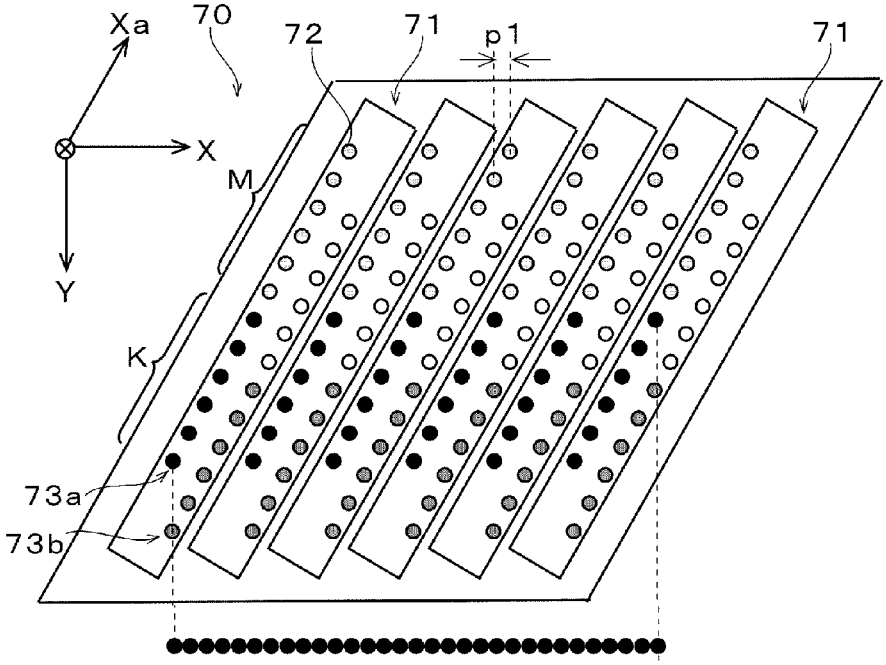
FIG. 21 is a schematic view illustrating array of nozzles in a head unit and array of dots in a third embodiment.
Figure 22:
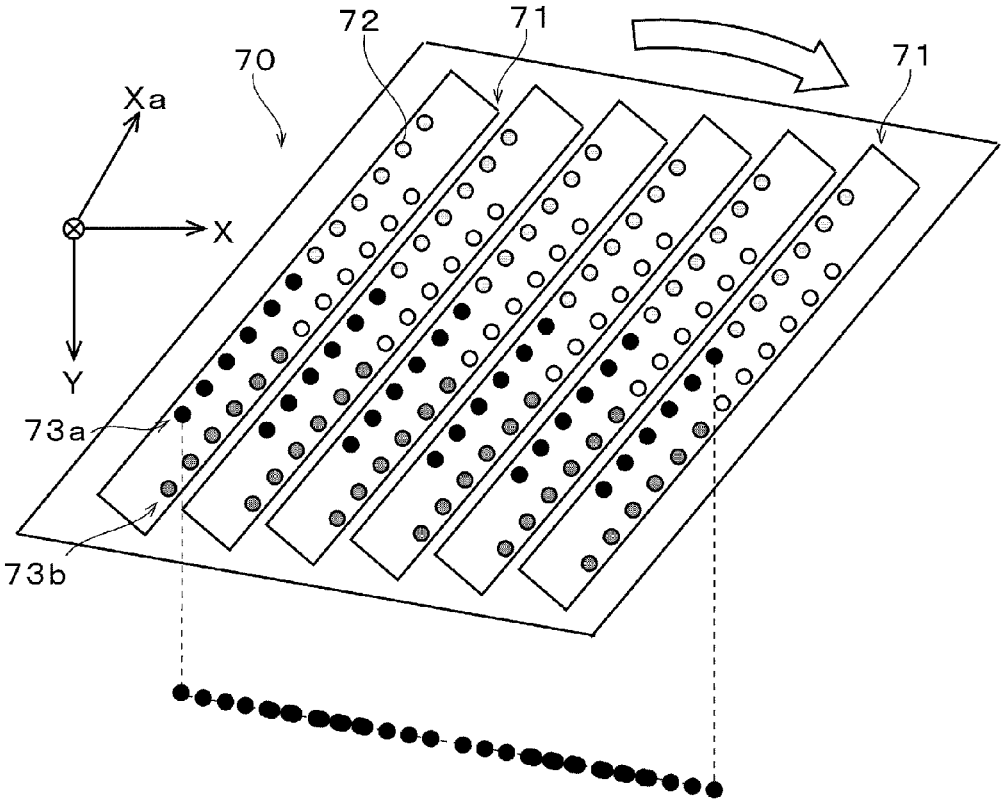
FIG. 22 is a schematic view illustrating the array of the nozzles in the head unit and the array of the dots in the third embodiment.

FIG. 21 and FIG. 22 are schematic views illustrating array of nozzles 72 of a head unit 70 and array of dots in a third embodiment of the invention. Although a case where a configuration, in which the nozzle lines 36 are formed in the X-axis direction (direction orthogonal to the recording medium 2 transporting direction), is applied has been described in each of the above embodiments, the invention is not limited to this case. This embodiment is different from each of the above embodiments in that each nozzle line 73 that has a unit head 71 in the head unit 70 is inclined with respect to the X-axis and the Y-axis at a predetermined angle (in an Xa direction in FIG. 21 and FIG. 22). In this embodiment, one nozzle line 73 discharges two types (two colors) of inks and thus two nozzle lines discharge four types (four colors) of inks in total. For example, a black ink (K) and a magenta ink (M) are allocated to one nozzle line 73*a* out of the nozzle lines 73 of the unit head 71 and a cyan ink (C) and a yellow ink (Y) are allocated to the other nozzle line 73*b*. In addition, the nozzle line 73*a* and the nozzle line 73*b* have the same number of nozzles 72 and the positions of the nozzles 72 of the nozzle line 73*a* in the X-axis direction and the positions of the nozzles 72 of the nozzle line 73*b* in the X-axis direction overlap each other when seen in the Y-axis direction. The allocation of the inks in the nozzle lines 73 is not limited thereto.

Other head units 70 have the same configuration and a recording head is configured such that a plurality of head units 70 are attached to a unit holding member. In such a configuration as well, the invention can be applied. That is, a configuration where the alignment shift is identified based on the alignment information, the correction information correlated with the alignment shift is identified based on the correction information table or the like correlated with the alignment shift in advance, and the correction information is applied to the control of the printing operation with respect to the recording medium 2 in the same procedures as the above embodiment can be adopted. In the configuration in this embodiment, depending on the line inclination, the full length of the array of dots in the X-axis direction is longer than the width of the recording medium 2 in some cases. That is, the number of nozzles 16 positioned on the outer side in the width direction of the recording medium 2 rises in an end portion in the X-axis direction of the nozzle group (including the plurality of nozzle lines) discharging the same color of ink. The nozzles 16 positioned on the outer side of the recording medium 2 due to such an alignment shift may be corrected such that the nozzles 16 are not used in the discharging operation. In other words, the number of nozzles to be used is changed (lowered). Accordingly, the printable width in the X-axis direction can be kept within an appropriate area.

In a case where the correction information corresponding to all of the alignment shifts is specified for each nozzle in the alignment correction table, data amount increases by the amount of the correction information and thus a burden of correction table preparation work before shipment of the printer 1 increases. Accordingly, correction information to be specified in the alignment correction table can be limited to more important information. For example, only the correction information for the nozzles 16 corresponding to the junction between the head units 3 can be specified in the alignment correction table. Similarly, a configuration in which the correction information corresponding to only the nozzles 16 (overlapping nozzles) that discharge the inks to a common region on the recording medium 2 between the head units 3 is specified in the alignment correction table can be adopted. Accordingly, a correction information data amount can be reduced and a burden of alignment correction table preparation work is lowered. In addition, for example, in a configuration where the recording head 4 is fixed in a state where the recording head 4 abuts against a head fixing surface that defines the attached position of the recording head 4 in the apparatus main body 7, it is not required to have the correction information related to the position shift of the recording head 4 in a direction orthogonal to the head fixing surface and thus the correction information data amount can be reduced by the amount of that correction information. Similarly, since it is not required to have the correction information related to the position shift of each of the head units 3 in a direction orthogonal to the fixing surface of the unit holding member 8 in a configuration where the head units 3 are fixed to the fixing surface of the unit holding member 8, the correction information data amount can be lowered by the amount of that correction information. Furthermore, for example, the correction information, which is one representative value, may be specified for each nozzle line in the alignment correction table and the correction information of each nozzle may be calculated based on the correction information, which is the representative value. In short, the correction information for all of the nozzles may not necessarily be specified in the alignment correction table.

In addition, the so-called line printer including a recording head configured such that a plurality of head units are attached to the unit holding member, in which the printing operation is performed while transporting the recording medium without the recording head performing a scanning, has been described in each of the above embodiments. Without being limited thereto, the invention can also be applied to a so-called serial printer in which the printing operation is performed while the recording head is caused to reciprocate and scan in a width direction of the recording medium.

Then, without being limited to the above printer 1, insofar as it is a liquid discharging apparatus, the invention can be applied to various ink jet recording apparatuses, such as a plotter, a facsimile device, and a copier, or a liquid discharging apparatus such as a textile printing apparatus that performs textile printing by causing inks to be landed onto cloth (material to be textile-printed), which is a type of the landing target, from the liquid discharging head.

What is claimed is:

1. A method for manufacturing a liquid discharging apparatus including a liquid discharging head that is attached to an apparatus main body so as to be capable of being attached or detached and that discharges a liquid from a nozzle, the method comprising:

identifying an alignment shift of the liquid discharging head attached to the apparatus main body, the alignment shift being identified from a print unit pattern, the print unit pattern including a plurality of dot lines and at least one reference dot line, the at least one reference dot line having a format that is different than a format of the plurality of dot lines; and identifying correction information that is correlated with the alignment shift identified in the identifying of the alignment shift based on a correction information table in which the correction information related to liquid discharge control and the alignment shift are correlated with each other.

2. The method for manufacturing the liquid discharging apparatus according to claim 1, wherein the alignment shift is a relative position shift between the apparatus main body and the liquid discharging head.

3. The method for manufacturing the liquid discharging apparatus according to claim 1, wherein the alignment shift is inclination of the liquid discharging head with respect to the apparatus main body.

4. The method for manufacturing the liquid discharging apparatus according to claim 1, wherein the liquid discharging head is fixed to a head fixing surface in the apparatus main body so as to be capable of being attached or detached, and the alignment shift is inclination of the liquid discharging head in a plane parallel to the head fixing surface.

5. The method for manufacturing the liquid discharging apparatus according to claim 1, wherein the liquid discharging head has a plurality of head units, and the alignment shift is a relative position shift between the head units.

6. The method for manufacturing the liquid discharging apparatus according to claim 5, wherein the correction information is correction information corresponding to only nozzles having a common region on a landing target to which the liquid is discharged between the head units.

7. The method for manufacturing the liquid discharging apparatus according to claim 1, wherein the correction information includes second nozzle complementary correction information related to complementary control for complementing discharge control of a first nozzle.

8. A liquid discharging apparatus comprising:

a liquid discharging head that is attached to an apparatus main body so as to be capable of being attached or detached and that discharges a liquid from a nozzle;

an input unit into which alignment information related to an alignment shift of the liquid discharging head in the apparatus main body is input, the alignment shift being identified from a print unit pattern, the print unit pattern including a plurality of dot lines and at least one reference dot line, the at least one reference dot line having a format that is different than a format of the plurality of dot lines; and a control circuit that identifies correction information from the alignment information and that applies the identified correction information to liquid discharge control performed by the liquid discharging head based on a correction information table in which the correction information related to the liquid discharge control and the alignment shift are correlated with each other.

9. The liquid discharging apparatus according to claim 8, wherein the control circuit changes, based on the alignment information, the number of nozzles to be used in the liquid discharge control performed by the liquid discharging head.

10. The liquid discharging apparatus according to claim 8, wherein the control circuit changes, based on the alignment information, a discharge amount for the nozzle positioned at a nozzle group end of the nozzle group that discharges the same type of the liquid in the liquid discharging head.

11. A device driver that is executable in an information processing apparatus capable of communicating with a liquid discharging apparatus and that identifies correction information related to discharge control of a liquid discharging head based on alignment information related to an alignment shift of the liquid discharging head in an apparatus main body of the liquid discharging apparatus, the alignment shift being identified from a print unit pattern, the print unit pattern including a plurality of dot lines and at least one reference dot line, the at least one reference dot line having a format that is different than a format of the plurality of dot lines.

* * * * *